US010535937B2

(12) United States Patent
Hashiguchi et al.

(10) Patent No.: US 10,535,937 B2
(45) Date of Patent: Jan. 14, 2020

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventors: Osamu Hashiguchi, Tokyo (JP); Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/278,671

(22) Filed: Feb. 18, 2019

(65) Prior Publication Data

US 2019/0273334 A1 Sep. 5, 2019

(30) Foreign Application Priority Data

Mar. 5, 2018 (JP) ..... 2018-038565

(51) Int. Cl.
*H01R 12/71* (2011.01)
*H01R 12/70* (2011.01)
*H01R 12/57* (2011.01)

(52) U.S. Cl.
CPC ..... *H01R 12/716* (2013.01); *H01R 12/57* (2013.01); *H01R 12/7011* (2013.01); *H01R 12/714* (2013.01)

(58) Field of Classification Search
CPC ..... H01R 12/714; H01R 12/716; H01R 12/7011; H01R 12/57
See application file for complete search history.

(56) References Cited

U.S. PATENT DOCUMENTS

| | | | | |
|---|---|---|---|---|
| 7,128,581 | B2 | 10/2006 | Igarashi et al. | |
| 8,961,215 | B2 | 2/2015 | Hasegawa | |
| 9,190,750 | B2 | 11/2015 | Takeuchi et al. | |
| 9,391,398 | B2 | 7/2016 | Omodachi et al. | |
| 9,748,677 | B2 | 8/2017 | Urano et al. | |
| 2012/0003859 | A1* | 1/2012 | Miyazaki | H01R 12/716 439/449 |

(Continued)

FOREIGN PATENT DOCUMENTS

| | | | |
|---|---|---|---|
| JP | 2004055306 | A | 2/2004 |
| JP | 2011060650 | A | 3/2011 |

(Continued)

*Primary Examiner* — James Harvey
(74) *Attorney, Agent, or Firm* — Holtz, Holtz & Volek PC

(57) ABSTRACT

A connector comprises a first member and a second member. The first member has a lock spring portion, a lock portion and a regulated portion. When the connector and a mating connector are in a mated state where the connector and the mating connector are mated with each other, the lock portion locks the mated state together with a locked portion of the mating connector. The first member is configured so that, when the mating connector is forced to be unmated from the connector under the mated state, the lock spring portion is resiliently deformed so that each of the lock portion and the regulated portion is moved in a combined direction of upward in an up-down direction and a first horizontal direction. The second member has a deformation-preventing portion provided with a regulating portion. A range of the movement of the regulated portion is defined by the regulating portion.

9 Claims, 19 Drawing Sheets

(56) References Cited

U.S. PATENT DOCUMENTS

| | | | | |
|---|---|---|---|---|
| 2012/0003875 | A1* | 1/2012 | Akai | H01R 12/716<br>439/660 |
| 2012/0052735 | A1* | 3/2012 | Hasegawa | H01R 12/57<br>439/626 |
| 2018/0331444 | A1* | 11/2018 | Ono | H01R 12/7011 |
| 2019/0190209 | A1* | 6/2019 | Horino | H01R 12/71 |

FOREIGN PATENT DOCUMENTS

| | | | |
|---|---|---|---|
| JP | 2014038822 | A | 2/2014 |
| JP | 5638026 | B2 | 12/2014 |
| JP | 2015185541 | A | 10/2015 |

* cited by examiner

CONNECTOR AND CONNECTOR ASSEMBLY

CROSS REFERENCE TO RELATED APPLICATIONS

This application is based on and claims priority under 35 U.S.C. § 119 to Japanese Patent Application No. JP2018-038565 filed Mar. 5, 2018, the contents of which are incorporated herein in their entireties by reference.

BACKGROUND OF THE INVENTION

This invention relates to a connector which is mateable with a mating connector, and to a connector assembly.

Referring to FIGS. 36 to 38, JP-A 2004-55306 (Patent Document 1) discloses a connector 900 which is mateable with a mating connector 950 in an up-down direction, or in a Z-direction. The mating connector 950 is provided with mating terminals 960 and locked portions 970. The connector 900 comprises terminals 910, a holding member 920 and lock members 930. The holding member 920 holds the terminals 910 and the lock members 930. The terminals 910 are connected with the mating terminals 960, respectively, when the connector 900 is mated with the mating connector 950. Each of the lock members 930 has attached portions 932, a lock spring portion 934 and a lock portion 936. The attached portions 932 are attached to the holding member 920. In the up-down direction, the lock spring portion 934 extends upward, or in a positive Z-direction. The lock portion 936 is supported by the lock spring portion 934. When the connector 900 and the mating connector 950 are in a mated state where the connector 900 and the mating connector 950 are mated with each other, the lock portions 936 lock the mated state together with the locked portions 970.

The mating connector 950 is unmateable from the connector 900 in an unmating direction which is upward. The lock spring portion 934 of the connector 900 of Patent Document 1 extends upward, or in the positive Z-direction. Accordingly, when the mating connector 950 is forced in the unmating direction, or in the positive Z-direction, under the mated state where the connector 900 and the mating connector 950 are mated with each other, the lock spring portion 934 may be deformed outward in a Y-direction and thereby the lock of the lock portion 936 against the locked portion 970 may be easily released.

The mating connector 950 is mateable with the connector 900 in a mating direction which is downward. If the connector 900 of Patent Document 1 is modified so that the lock spring portion 934 extends downward, or in a negative Z-direction, the modified connector 900 is preferred because, when the mating connector 950 is forced in the unmating direction, or in the positive Z-direction, under a mated state where the modified connector 900 and the mating connector 950 are mated with each other, the modified lock spring portion 934 is deformed inward in the Y-direction so that a lock of the lock portion 934 against the locked portion 970 is firmly maintained. However, if the applied force to the mating connector 950, which is directed to the unmating direction, or to the positive Z-direction, is increased, the lock spring portion 934 might be plastically deformed to be broken.

SUMMARY OF THE INVENTION

It is therefore an object of the present invention to provide a connector having a structure which prevents a breakage of a lock spring portion while ensuring a locking force of a lock portion and a locked portion.

One aspect of the present invention provides a connector mateable with a mating connector in an up-down direction. The mating connector comprises a mating terminal and a locked portion. The connector comprises a terminal, a holding member, a first member and a second member. The holding member holds the terminal, the first member and the second member. The holding member has at least a first side wall and a second side wall. The first side wall intersects with a first horizontal direction perpendicular to the up-down direction. The second side wall intersects with a second horizontal direction perpendicular to both the up-down direction and the first horizontal direction. The terminal is connected with the mating terminal when the connector is mated with the mating connector. The first member has a first attached portion, a lock spring portion, a lock portion and a regulated portion. The first attached portion is attached to the first side wall. The lock spring portion extends in the first horizontal direction and downward in the up-down direction from the first attached portion. When the connector and the mating connector are in a mated state where the connector and the mating connector are mated with each other, the lock portion locks the mated state together with the locked portion. Each of the lock portion and the regulated portion is supported by the lock spring portion. The first member is configured so that, when the mating connector is forced to be unmated from the connector under the mated state, the lock spring portion is resiliently deformed so that each of the lock portion and the regulated portion is moved in a combined direction of upward in the up-down direction and the first horizontal direction. The second member has a second attached portion and a deformation-preventing portion. The second attached portion is attached to the second side wall. The deformation-preventing portion extends downward in the up-down direction from the second attached portion. The deformation-preventing portion is provided with a regulating portion. A range of the movement of the regulated portion is defined by the regulating portion.

In the connector of the present invention, the first member is provided with the lock portion and the regulated portion which are supported by the lock spring portion, and the second member is provided with the regulating portion. In addition, the first member is configured so that, when the mating connector is forced to be unmated from the connector under the mated state where the connector and the mating connector are mated with each other, the lock spring portion is resiliently deformed so that each of the lock portion and the regulated portion is moved in the combined direction of upward in the up-down direction and the first horizontal direction. Furthermore, the range of the movement of the regulated portion is defined by the regulating portion. Accordingly, a breakage of the lock spring portion can be prevented while a locking force of the lock portion of the first member of the connector and the locked portion of the mating connector can be ensured.

In the connector of the present invention, the first side wall, to which the first attached portion of the first member is attached, intersects with the first horizontal direction perpendicular to the up-down direction, while the second side wall, to which the second attached portion of the second member is attached, intersects with the second horizontal direction perpendicular to both the up-down direction and the first horizontal direction. Accordingly, the regulating portion can securely define the range of the movement of the regulated portion.

An appreciation of the objectives of the present invention and a more complete understanding of its structure may be had by studying the following description of the preferred embodiment and by referring to the accompanying drawings.

Figure 1:
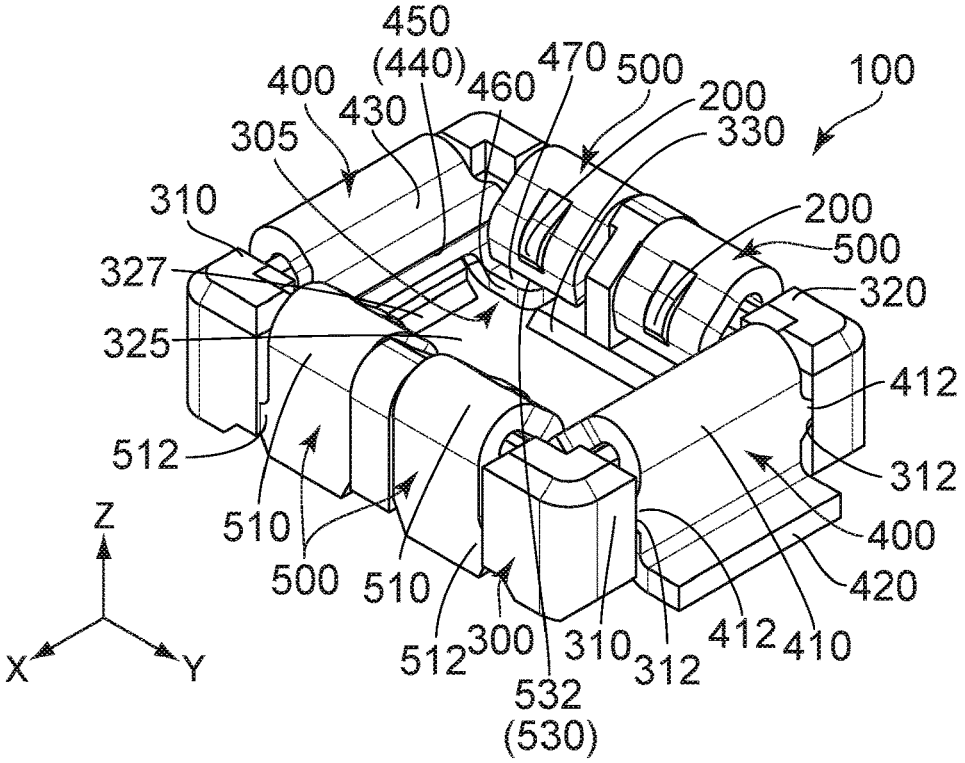
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 7:
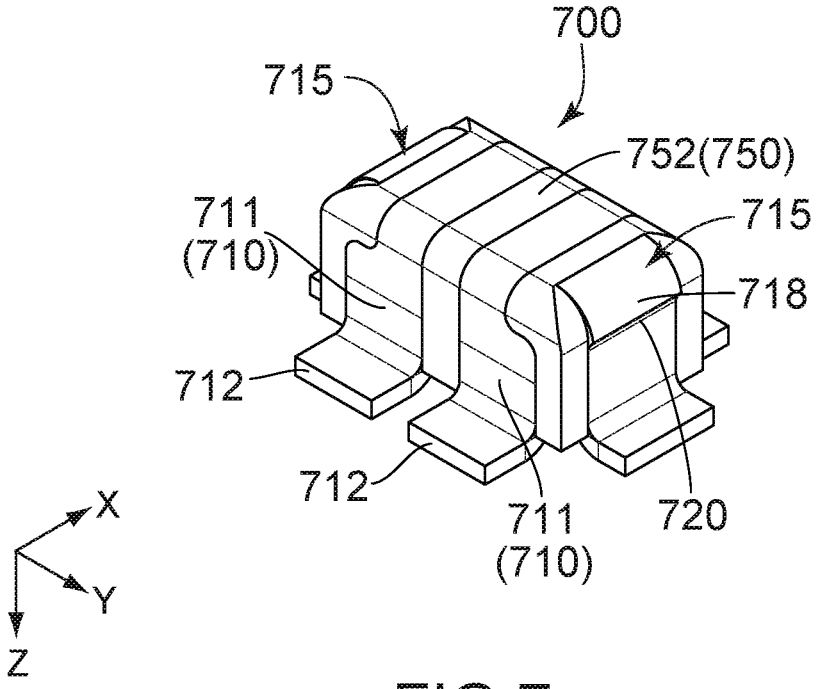
FIG. 7 is a perspective view showing a mating connector according to the first embodiment of the present invention.

Referring to FIGS. 1 and 7, a connector assembly according to a first embodiment of the present invention comprises a connector 100 and a mating connector 700.

Referring to FIGS. 1 and 7, the connector 100 according to the first embodiment of the present invention is mateable with the mating connector 700 according to the first embodiment of the present invention in an up-down direction. Specifically, the connector 100 of the present embodiment is a receptacle, while the mating connector 700 of the present embodiment is a plug. In the present embodiment, the up-down direction is a Z-direction. It is assumed that upward is a positive Z-direction while downward is a negative Z-direction. A method of mating the connector 100 with the mating connector 700 is described later.

Figure 8:
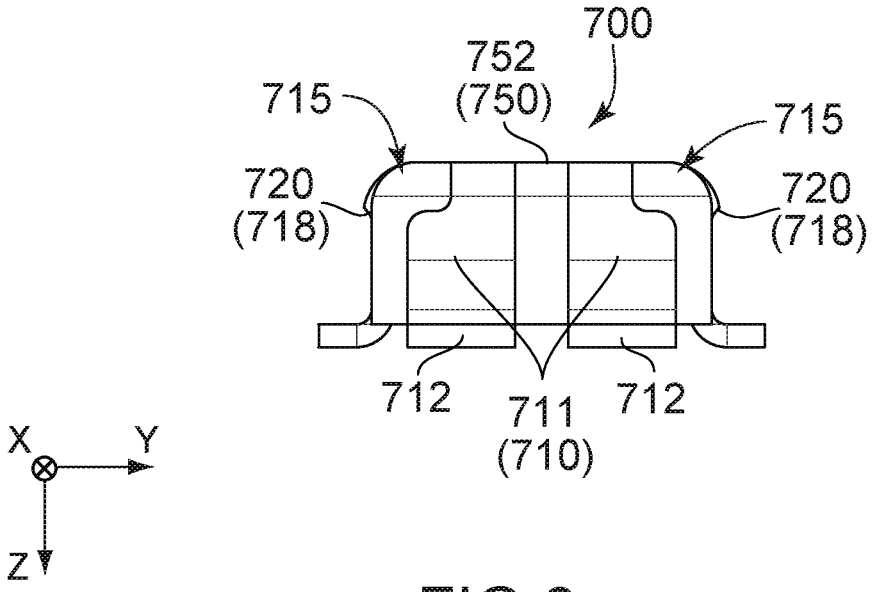
FIG. 8 is a side view showing the mating connector of FIG. 7.

As shown in FIGS. 7 and 8, the mating connector 700 of the present embodiment is provided with a mating holding member 750, four mating terminals 710 and two lock members 715.

As shown in FIGS. 7 and 8, the mating holding member 750 of the present embodiment has a substantially rectangular shape which extends in a first horizontal direction. More specifically, the mating holding member 750 has two outer surfaces, each of which faces in the first horizontal direction, another two outer surfaces, each of which faces in a second horizontal direction, and an end surface 752 which faces downward in the up-down direction. In the present embodiment, the first horizontal direction is a Y-direction, and the second horizontal direction is an X-direction.

As shown in FIGS. 7 and 8, each of the mating terminals 710 of the present embodiment has a contact portion 711 and a fixed portion 712. The contact portion 711 of the present embodiment has a plate-like shape perpendicular to the second horizontal direction. The contact portion 711 is held by the outer surface of the mating holding member 750 which faces in the second horizontal direction. The fixed portion 712 of the present embodiment has a plate-like shape perpendicular to the up-down direction. The fixed portion 712 extends outward in the second horizontal direction from an upper end of the contact portion 711.

As shown in FIGS. 7 and 8, the lock member 715 of the present embodiment is held by the outer surface of the mating holding member 750 which faces in the first horizontal direction. Each of the lock members 715 has a protrusion 718. The protrusion 718 protrudes outward in the first horizontal direction and has a locked portion 720. More specifically, the locked portion 720 is an upper surface of the protrusion 718. In other words, the mating connector 700 of the present embodiment is provided with the mating terminals 710 and the locked portions 720.

Figure 4:
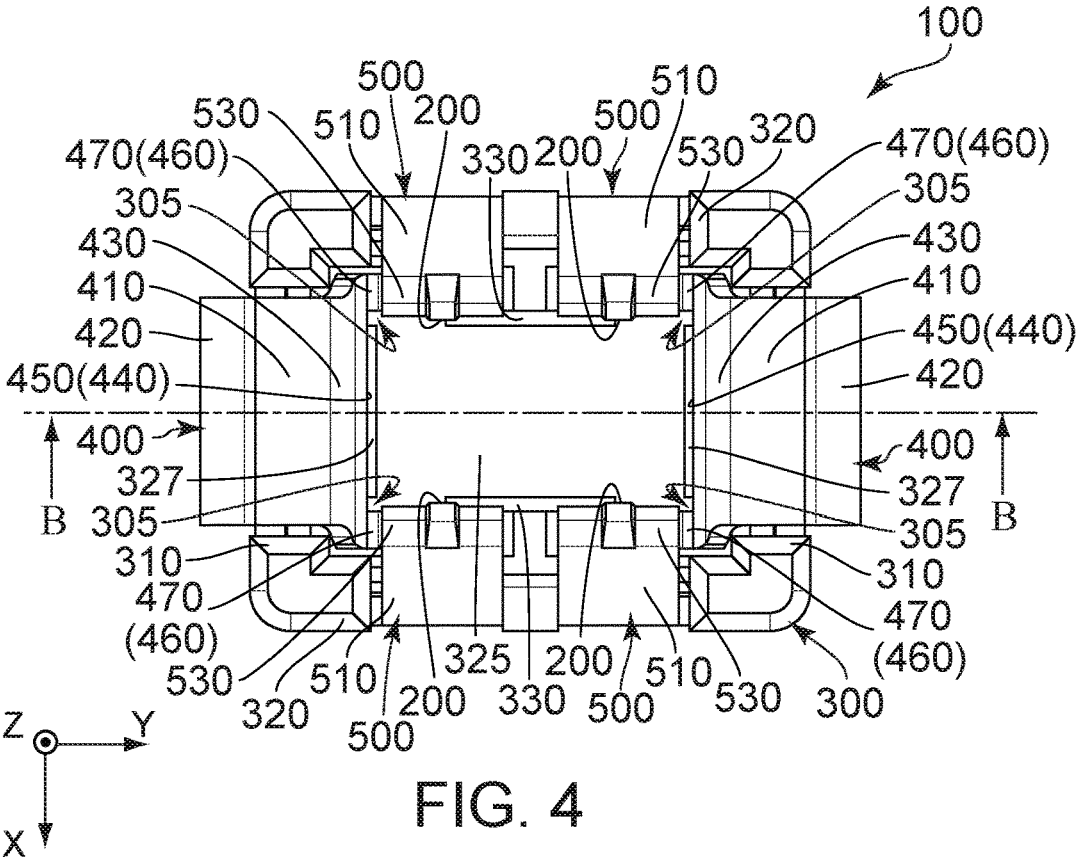
FIG. 4 is a top view showing the connector of FIG. 1.

As shown in FIG. 4, the connector 100 of the present embodiment comprises a holding member 300, four terminals 200, two first members 400 and four second members 500.

Referring to FIG. 4, the holding member 300 of the present embodiment is made of insulator. The holding member 300 has two first side walls 310, two second side walls 320, a bottom surface 325, two first partitions 327 and two second partitions 330. A structure, which is formed by the two first side walls 310 and the two second side walls 320, has a substantially angular O-shape when viewed from above in the up-down direction. However, the present invention is not limited thereto. It is sufficient that the holding member 300 has at least the first side wall 310 and the second side wall 320.

Figure 2:
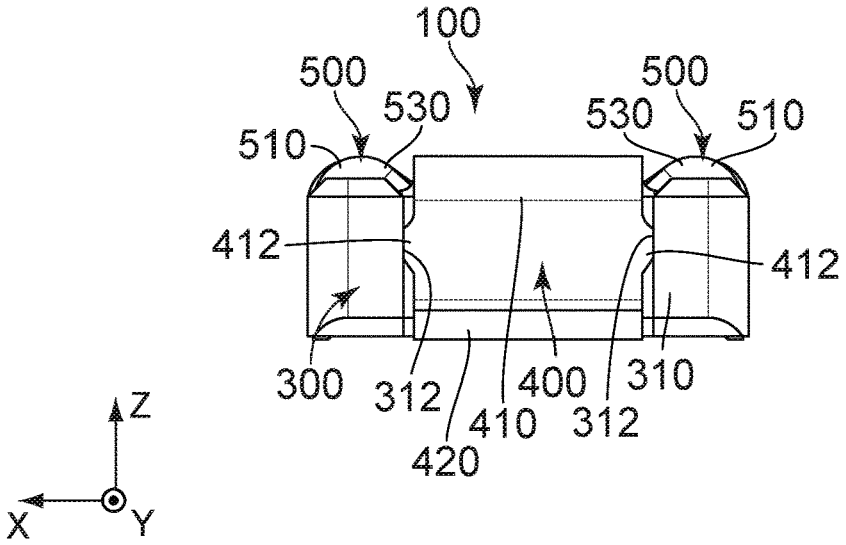
FIG. 2 is a front view showing the connector of FIG. 1.

As shown in FIG. 4, the first side walls 310 of the present embodiment are positioned at opposite ends, respectively, of the holding member 300 in the first horizontal direction. Each of the first side walls 310 of the present embodiment intersects with the first horizontal direction perpendicular to the up-down direction. More specifically, each of the first side walls 310 is perpendicular to the first horizontal direction. As shown in FIG. 2, each of the first side walls 310 has first press-fitted portions 312.

Figure 3:
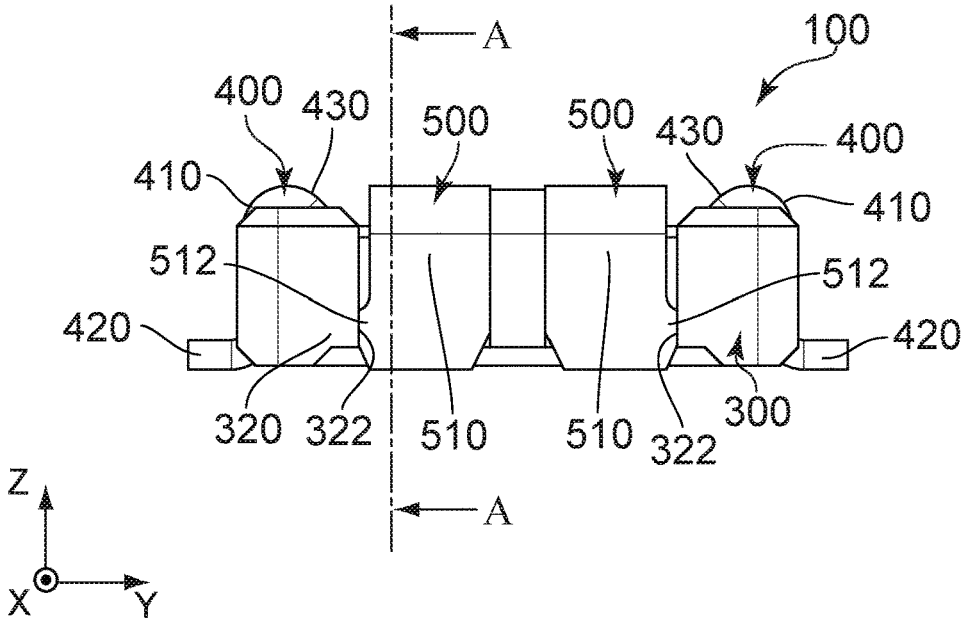
FIG. 3 is a side view showing the connector of FIG. 1.

As shown in FIG. 4, the second side walls 320 of the present embodiment are positioned at opposite ends, respectively, of the holding member 300 in the second horizontal direction. Each of the second side walls 320 of the present embodiment intersects with the second horizontal direction perpendicular to both the up-down direction and the first horizontal direction. More specifically, each of the second side walls 320 is perpendicular to the second horizontal direction. As shown in FIG. 3, each of the second side walls 320 has second press-fitted portions 322.

As shown in FIGS. 1 and 4, the bottom surface 325 of the present embodiment has a plate-like shape perpendicular to the up-down direction. The bottom surface 325 is connected with a lower end of each of the first side walls 310 and the second side walls 320.

Figure 5:
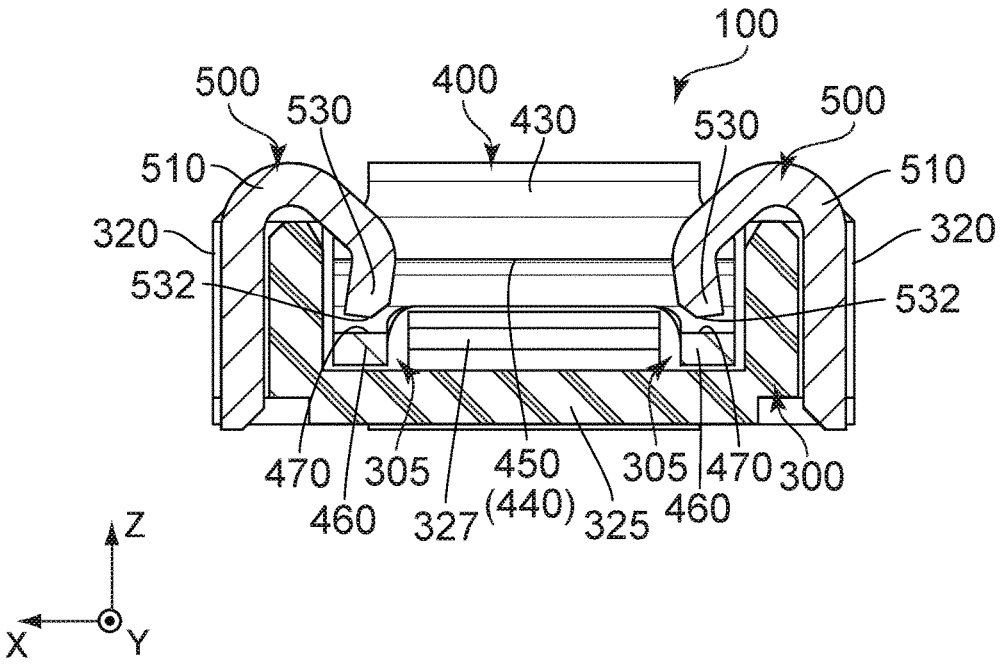
FIG. 5 is a cross-sectional view showing the connector of FIG. 3, taken along line A-A.
Figure 6:
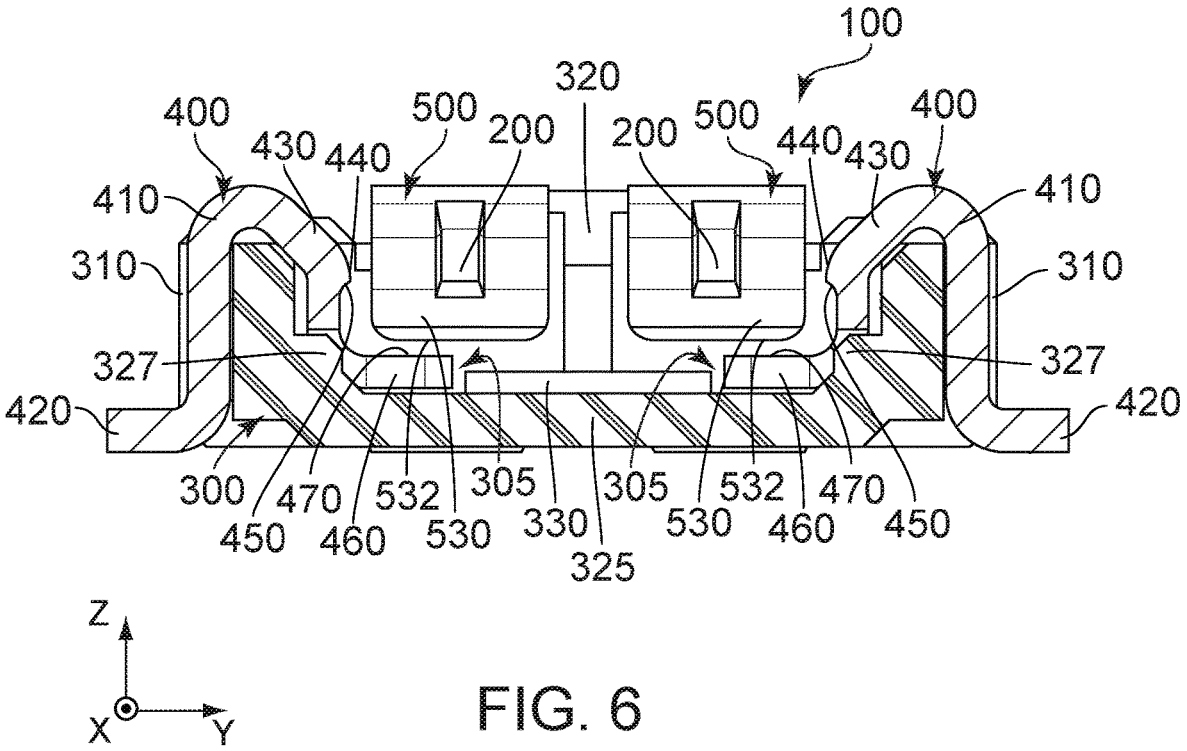
FIG. 6 is a cross-sectional view showing the connector of FIG. 4, taken along line B-B.

As shown in FIG. 5, each of the first partitions 327 of the present embodiment extends upward in the up-down direction from the bottom surface 325. As shown in FIG. 6, the first partitions 327 extend inward in the first horizontal direction from the first side walls 310, respectively.

As shown in FIG. 6, each of the second partitions 330 of the present embodiment extends upward in the up-down direction from the bottom surface 325. Referring to FIG. 1, the second partitions 330 extend inward in the second horizontal direction from the second side walls 320, respectively.

As shown in FIGS. 4 to 6, the holding member 300 of the present embodiment has four accommodating portions 305. Each of the accommodating portions 305 is positioned above the bottom surface 325. The two first side walls 310 and the two second side walls 320 of the holding member 300 form a structure having four corners. The accommodating portions 305 are positioned in the vicinities of the four corners, respectively. The accommodating portion 305 is positioned outward beyond the first partition 327 in the second horizontal direction. The accommodating portion 305 is positioned outward beyond the second partition 330 in the first horizontal direction.

As shown in FIGS. 1 and 4, the holding member 300 of the present embodiment holds the terminals 200, the first members 400 and the second members 500. The first members 400 are held by the first side walls 310, respectively, of the holding member 300. The terminal 200 and the second member 500 are held by the second side wall 320 of the holding member 300. More specifically, two of the terminals 200 and two of the second members 500 are held by one of the second side walls 320 of the holding member 300, while remaining two of the terminals 200 and remaining two of the second members 500 are held by a remaining one of the second side walls 320 of the holding member 300.

Referring to FIG. 6, each of the terminals 200 of the present embodiment is made of conductor. The terminals 200 correspond to the second members 500, respectively, and each of the terminals 200 and the second member 500 corresponding thereto are integrally formed with each other. In other words, the second member 500 of the present embodiment also functions as the terminal 200. However, the present invention is not limited thereto. The terminal 200 may be distinct and separated from the second member 500. Referring to FIGS. 1 and 7, the terminals 200 of the present embodiment are connected with the mating terminals 710, respectively, when the connector 100 is mated with the mating connector 700.

Referring to FIGS. 5 and 6, each of the first members 400 of the present embodiment is made of conductor. Specifically, each of the first members 400 has a first attached portion 410, a lock spring portion 430, a protrusion 440, a lock portion 450, two extending portions 460, two regulated portions 470 and a fixed portion 420.

As shown in FIGS. 1 to 4, the first attached portion 410 of the present embodiment extends upward in the up-down direction from the fixed portion 420. The first attached portion 410 has two first press-fit portions 412 which are positioned at its opposite outer ends, respectively, in the second horizontal direction. The first attached portions 410 of the first members 400 of the present embodiment are attached to the first side walls 310, respectively, of the holding member 300. More specifically, the first press-fit portions 412 of the first attached portion 410 of the first member 400 are press-fit into the first press-fitted portions 312, respectively, of the corresponding first side wall 310 to be attached thereto.

As shown in FIGS. 1 and 6, the lock spring portion 430 of the present embodiment extends in the first horizontal direction and downward in the up-down direction from the first attached portion 410. More specifically, the lock spring portion 430 of the present embodiment extends inward in the first horizontal direction and downward in the up-down direction from the first attached portion 410.

Referring to FIGS. 1 and 4 to 6, the protrusion 440 of the present embodiment protrudes inward in the first horizontal direction from the lock spring portion 430. The protrusion 440 is supported by the lock spring portion 430. The protrusion 440 has the lock portion 450. More specifically, the lock portion 450 is a lower surface of the protrusion 440. Specifically, the lock portion 450 is supported by the lock spring portion 430. Referring to FIGS. 6 and 8, the lock portions 450 of the first members 400 of the connector 100 correspond to the locked portions 720 of the lock members 715, respectively, of the mating connector 700. When the connector 100 and the mating connector 700 are in a mated state where the connector 100 is mated with the mating connector 700, each of the lock portions 450 locks the mated state together with the corresponding locked portion 720.

As shown in FIGS. 1 and 4 to 6, each of the extending portions 460 of the present embodiment has a substantially plate-like shape which intersects with the up-down direction. The extending portions 460 of the present embodiment extend inward in the first horizontal direction from lower ends of the lock spring portion 430 which are positioned at its opposite ends, respectively, in the second horizontal direction. Specifically, each of the extending portions 460 is supported by the lock spring portion 430. Each of the extending portions 460 is positioned above the bottom surface 325 of the holding member 300 in the up-down direction. The extending portion 460 is accommodated in the accommodating portion 305 of the holding member 300. The extending portion 460 is positioned outward beyond the second partition 330 of the holding member 300 in the first horizontal direction. The extending portion 460 is positioned outward beyond the first partition 327 of the holding member 300 in the second horizontal direction.

Referring to FIGS. 1 and 4 to 6, each of the extending portions 460 of the present embodiment is provided with the regulated portion 470. More specifically, the regulated portion 470 of the present embodiment is an upper surface of the extending portion 460. Specifically, the connector 100 of the present embodiment has four of the regulated portions 470. The regulated portion 470 is supported by the lock spring portion 430. The regulated portions 470 are accommodated in the accommodating portions 305, respectively, of the holding member 300. Specifically, the holding member 300 is provided with the accommodating portions 305 which accommodate the regulated portions 470, respectively. The regulated portion 470 is positioned outward beyond the second partition 330 of the holding member 300 in the first horizontal direction. The regulated portion 470 is positioned outward beyond the first partition 327 of the holding member 300 in the second horizontal direction.

As shown in FIGS. 1 and 4, the second member 500 of the present embodiment is distinct and separated from the first member 400. However, the present invention is not limited thereto. The first member 400 and the second member 500 may be integrally formed with each other.

Referring to FIGS. 1 and 4, each of the second members 500 of the present embodiment is made of conductor. Each of the second members 500 has a second attached portion 510 and a deformation-preventing portion 530.

As shown in FIGS. 1 and 3, the second attached portion 510 of the present embodiment extends in the up-down direction. The second attached portion 510 has a second press-fit portion 512 which is positioned at its outer end in the first horizontal direction. The second attached portion 510 is attached to the second side wall 320. More specifically, the second press-fit portion 512 of the second attached portion 510 of the second member 500 is press-fit into the second press-fitted portion 322 of the second side wall 320.

As shown in FIGS. 1 and 5, the deformation-preventing portion 530 of the present embodiment extends downward in the up-down direction from the second attached portion 510. The deformation-preventing portion 530 of the present embodiment is provided with a regulating portion 532. More specifically, the regulating portion 532 of the present embodiment is a lower end of the deformation-preventing portion 530. Specifically, the connector 100 of the present embodiment has four of the regulating portions 532. The accommodating portions 305 of the holding member 300 are positioned below the regulating portions 532, respectively, in the up-down direction. The regulated portion 470 of the first member 400 is positioned below the regulating portion 532 of the deformation-preventing portion 530 of the second member 500 in the up-down direction. More specifically, in the connector 100 of the present embodiment, the four regulated portion 470 correspond to the four regulating portions 532, respectively, and each of the regulated portions 470 is positioned below the corresponding regulating portion 532 in the up-down direction. The regulating portion 532 is positioned outward beyond the first partition 327 of the holding member 300 in the second horizontal direction. The regulating portion 532 is positioned outward beyond the second partition 330 of the holding member 300 in the first horizontal direction. The regulating portion 532 is positioned above the second partition 330 of the holding member 300 in the up-down direction.

A method of mating the connector 100 with the mating connector 700 is described below.

Referring to FIGS. 1, 6, 7 and 8, the connector 100 and the mating connector 700 are positioned so that the bottom surface 325 of the holding member 300 of the connector 100 faces the end surface 752 of the mating holding member 750 of the mating connector 700 in the up-down direction while the protrusions 440 of the lock spring portions 430 of the first members 400 of the connector 100 face the protrusions 718 of the lock members 715, respectively, of the mating connector 700 in the up-down direction. At this time, the mating terminals 710 of the mating connector 700 are positioned above the terminals 200, respectively, of the connector 100 in the up-down direction.

Next, when the mating connector 700 is moved downward relative to the connector 100, each of the protrusions 440 of the lock spring portions 430 of the first members 400 of the connector 100 is brought into contact with the corresponding protrusion 718 of the lock member 715 of the mating connector 700.

After that, when the mating connector 700 is further moved downward relative to the connector 100, the lock spring portion 430 of each of the first members 400 of the connector 100 is resiliently deformed outward in the first horizontal direction so that the protrusion 440 is moved outward in the first horizontal direction. When the mating connector 700 continues to be moved downward in this state, the lock portion 450 of the protrusion 440 of each of the first members 400 of the connector 100 reaches a position same as a position of the locked portion 720 of the protrusion 718 of the corresponding lock member 715 of the mating connector 700 in the up-down direction.

At this time, the lock spring portion 430 of the first member 400 of the connector 100 restores its original shape while the protrusion 440 returns to its original position in the first horizontal direction. Meanwhile, the lock portion 450 of the protrusion 440 of each of the first members 400 of the connector 100 faces the locked portion 720 of the protrusion 718 of the corresponding lock member 715 of the mating connector 700 in the up-down direction. In other words, the connector 100 and the mating connector 700 are in the mated state. Also meanwhile, each of the terminals 200 of the connector 100 is in contact with the contact portion 711 of the corresponding mating terminal 710 of the mating connector 700. In other words, the terminals 200 of the connector 100 are connected with the mating terminals 710, respectively, of the mating connector 700.

Movements of the components of the connector 100 upon the mating connector 700 being forced to be unmated from the connector 100 under the mated state where the connector 100 is mated with the mating connector 700 are described in detail hereinafter.

Referring to FIGS. 1 and 5 to 8, when the mating connector 700 is forced to be unmated from the connector 100 under the mated state where the connector 100 is mated with the mating connector 700, the lock spring portion 430 of the first member 400 of the connector 100 is resiliently deformed so that each of the lock portion 450 and the regulated portion 470 of the first member 400 of the connector 100 is moved in a combined direction of upward in the up-down direction and the first horizontal direction. More specifically, when the mating connector 700 is forced to be unmated from the connector 100 under the mated state where the connector 100 is mated with the mating connector 700, the lock spring portion 430 of the first member 400 of the connector 100 is resiliently deformed so that each of the lock portion 450 and the regulated portion 470 of the first member 400 of the connector 100 is moved in a combined direction of upward in the up-down direction and inward in the first horizontal direction.

In other words, the first member 400 is configured so that, when the mating connector 700 is forced to be unmated from the connector 100 under the mated state where the connector 100 is mated with the mating connector 700, the lock spring portion 430 is resiliently deformed so that each of the lock portion 450 and the regulated portion 470 is moved in the combined direction of upward in the up-down direction and the first horizontal direction.

If the lock spring portion 430 is about to be excessively deformed under this case, the regulated portion 470 of the first member 400 abuts against the regulating portion 532 of the deformation-preventing portion 530 of the second member 500, so that the regulating portion 532 of the deformation-preventing portion 530 of the second member 500 regulates the movement of the regulated portion 470 of the first member 400. More specifically, if the lock spring portion 430 is about to be excessively deformed under this case, the regulated portion 470 of the first member 400 abuts from below against the regulating portion 532 of the deformation-preventing portion 530 of the second member 500 in the up-down direction, so that the regulating portion 532 of the deformation-preventing portion 530 of the second member 500 regulates the upward movement of the regulated portion 470 of the first member 400.

Specifically, if the lock spring portion 430 is about to be excessively deformed when the mating connector 700 is forced to be unmated from the connector 100 under the mated state where the connector 100 is mated with the mating connector 700, the regulated portion 470 abuts against the regulating portion 532 so that the regulating portion 532 regulates the movement of the regulated portion 470. In other words, a range of the movement of the regulated portion 470 is defined by the regulating portion 532. More specifically, if the lock spring portion 430 is about to be excessively deformed when the mating connector 700 is forced to be unmated from the connector 100 under the mated state where the connector 100 is mated with the mating connector 700, the regulated portion 470 abuts from below against the regulating portion 532 in the up-down direction so that the regulating portion 532 regulates the movement of the regulated portion 470. In other words, an upper limit of the range of the movement of the regulated portion 470 is defined by the regulating portion 532.

As described above, the connector 100 is configured so that the first side wall 310, to which the first attached portion 410 of the first member 400 is attached, is perpendicular to the first horizontal direction while the second side wall 320, to which the second attached portion 510 of the second member 500 is attached, is perpendicular to the second horizontal direction. Thus, as compared with a case where the first side wall 310 and the second side wall 320 are aligned with each other, the regulated portion 470 can abut against the regulating portion 532 with large contact area when the lock spring portion 430 is about to be excessively deformed upon the mating connector 700 being forced to be unmated from the connector 100 under the mated state where the connector 100 is mated with the mating connector 700.

The connector 100 of the present embodiment is configured so that, when the mating connector 700 is forced to be unmated from the connector 100 under the mated state where the connector 100 is mated with the mating connector 700, each of the lock portion 450 and the regulated portion 470, which is supported by the lock spring portion 430, is moved inward in the first horizontal direction. Accordingly, the second member 500 of the connector 100 of the present embodiment can be arranged inward of the lock spring portion 430 of the first member 400 in a direction in which the lock spring portion 430 is deformed when the mating connector 700 is forced to be unmated from the connector 100. Thus, the connector 100 can be easily configured.

Second Embodiment

Figure 9:
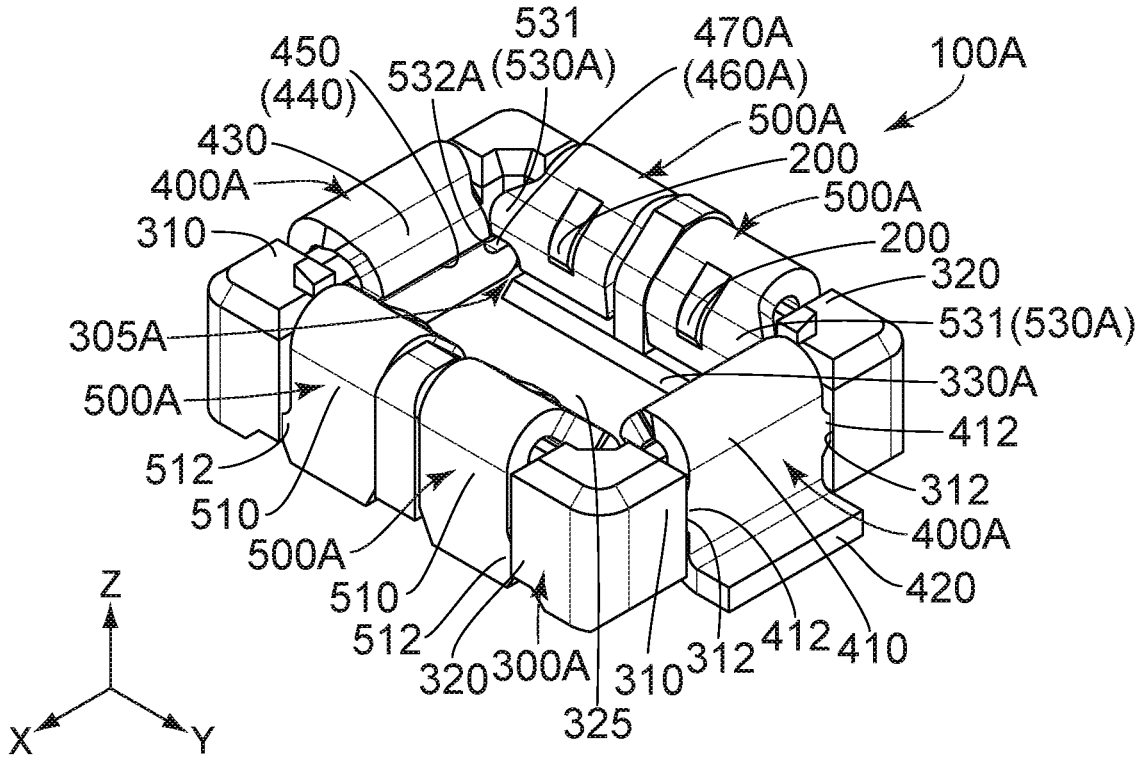
FIG. 9 is a perspective view showing a connector according to a second embodiment of the present invention.
Figure 10:
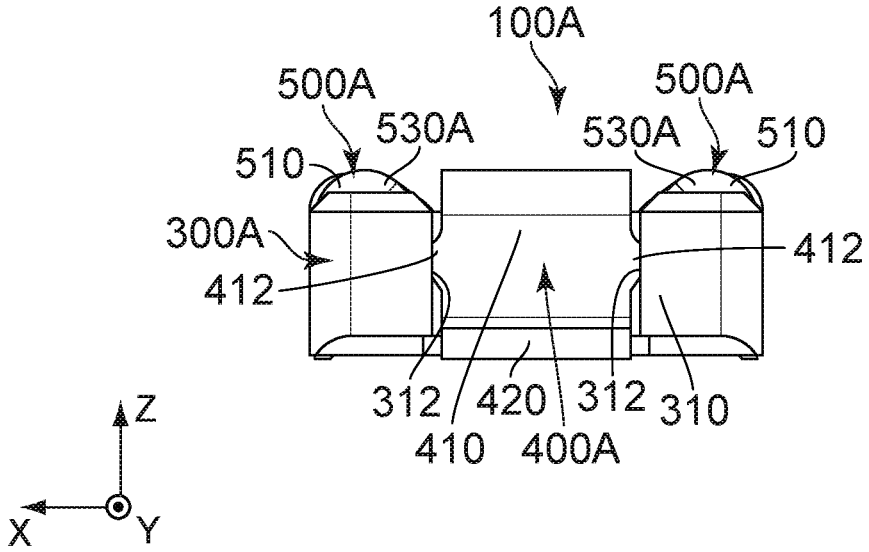
FIG. 10 is a front view showing the connector of FIG. 9.
Figure 11:
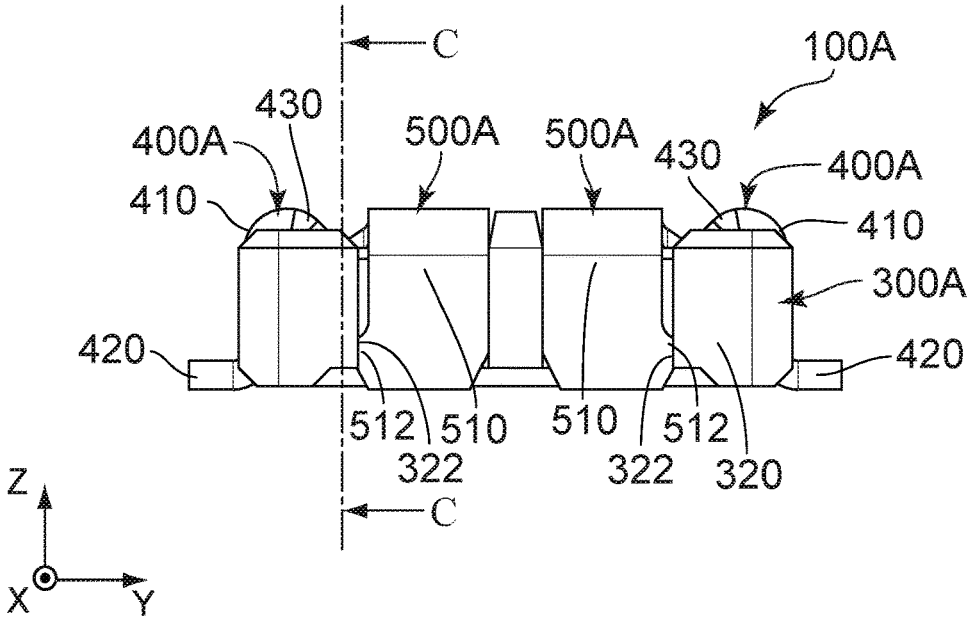
FIG. 11 is a side view showing the connector of FIG. 9.

Referring to FIGS. 7 and 9, a connector assembly according to a second embodiment of the present embodiment comprises a connector 100A and a mating connector 700.

Referring to FIGS. 7 and 9, the connector 100A according to the second embodiment of the present invention is mateable with the mating connector 700 in the up-down direction. Specifically, the connector 100A of the present embodiment is a receptacle. The mating connector 700 of the present embodiment has a structure same as that of the mating connector 700 of the first embodiment. As for directions and orientations in the present embodiment, expressions same as those of the first embodiment will be used hereinbelow. A method of mating the connector 100A with the mating connector 700 is similar to the method of the first embodiment. Accordingly, detailed explanation thereabout is omitted.

As shown in FIG. 9, the connector 100A of the present embodiment comprises a holding member 300A, four terminals 200, two first members 400A and four second members 500A. As for the aforementioned components of the connector 100A, the terminal 200 has a structure same as that of the connector 100 of the first embodiment. Accordingly, detailed explanation thereabout is omitted.

Figure 12:
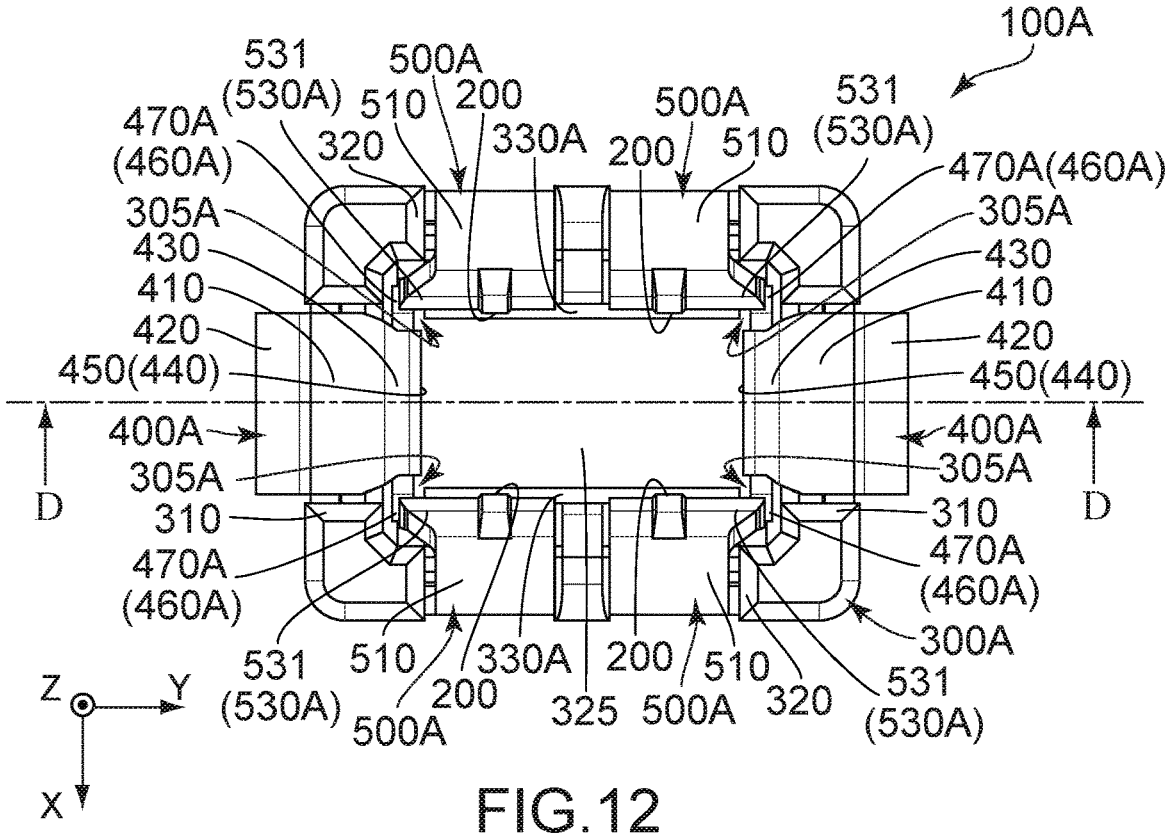
FIG. 12 is a top view showing the connector of FIG. 9.

Referring to FIG. 12, the holding member 300A of the present embodiment is made of insulator. The holding member 300A has two first side walls 310, two second side walls 320, a bottom surface 325 and two second partitions 330A. As for the aforementioned components of the holding member 300A, the first side wall 310, the second side wall 320 and the bottom surface 325 have structures same as those of the holding member 300 of the first embodiment. Accordingly, detailed explanation thereabout is omitted.

Figure 14:
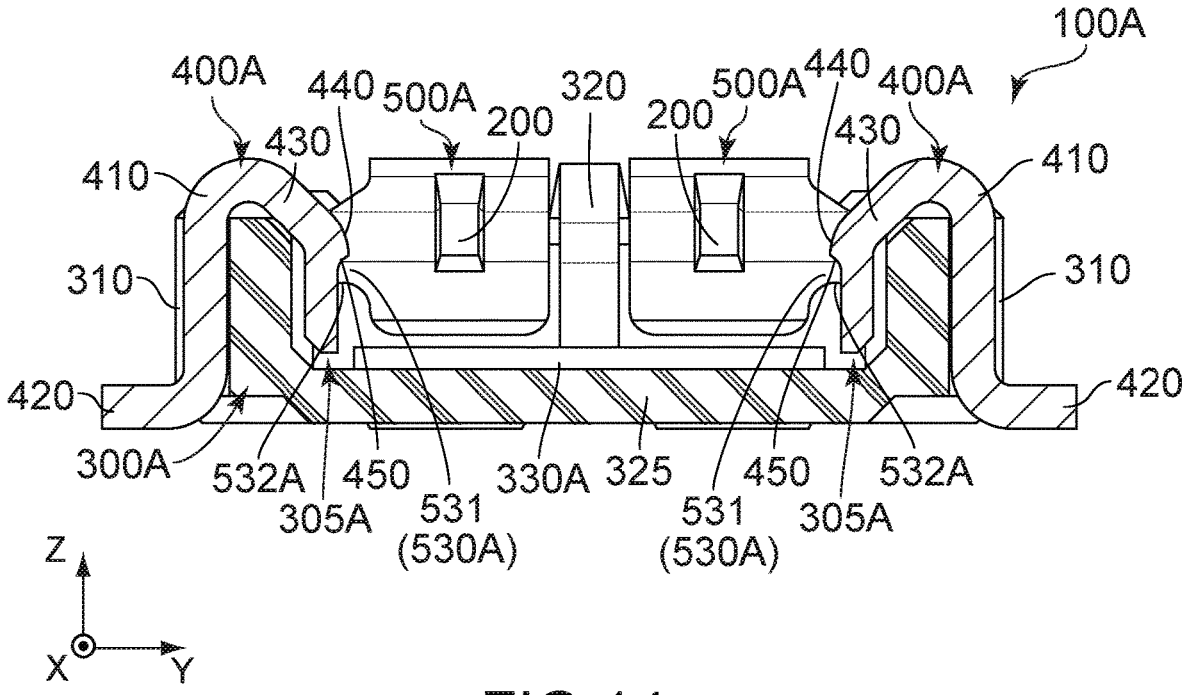
FIG. 14 is a cross-sectional view showing the connector of FIG. 12, taken along line D-D.

As shown in FIG. 14, each of the second partitions 330A of the present embodiment extends upward from the bottom surface 325. Referring to FIG. 9, the second partitions 330A extend inward in the second horizontal direction from the second side walls 320, respectively.

As shown in FIGS. 9 and 12 to 14, the holding member 300A of the present embodiment is provided with four accommodating portions 305A. Each of the accommodating portions 305A is positioned above the bottom surface 325. The two first side walls 310 and the two second side walls 320 form a structure having four corners. The accommodating portions 305A are positioned in the vicinities of the four corners, respectively. The accommodating portion 305A is positioned outward beyond the second partition 330A in the first horizontal direction.

As shown in FIG. 9, the holding member 300A of the present embodiment holds the terminals 200, the first members 400A and the second members 500A. The first members 400A are held by the first side walls 310, respectively, of the holding member 300A. The terminal 200 and the second member 500A are held by the second side wall 320 of the holding member 300A. More specifically, two of the terminals 200 and two of the second members 500A are held by one of the second side walls 320 of the holding member 300A, while remaining two of the terminals 200 and remaining two of the second members 500A are held by a remaining one of the second side walls 320 of the holding member 300A.

Figure 13:
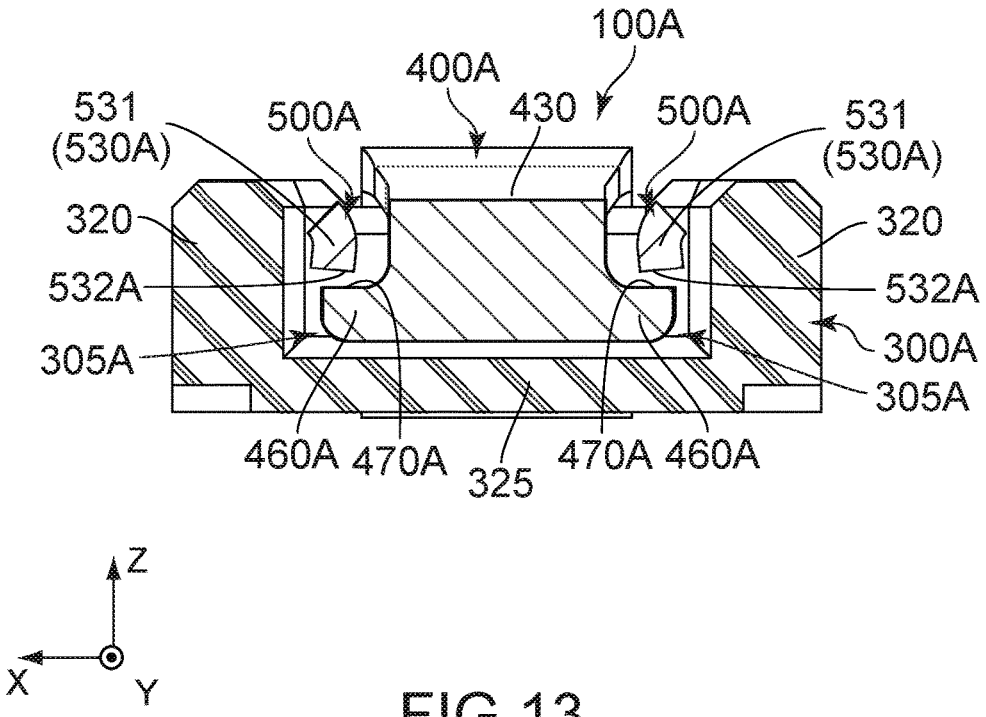
FIG. 13 is a cross-sectional view showing the connector of FIG. 11, taken along line C-C.

Referring to FIGS. 13 and 14, each of the first members 400A of the present embodiment is made of conductor. Each of the first members 400A has a first attached portion 410, a lock spring portion 430, a protrusion 440, a lock portion 450, two extending portions 460A, two regulated portions 470A and a fixed portion 420. As for the aforementioned components of the connector 100A, the first attached portion 410, the lock spring portion 430, the protrusion 440, the lock portion 450 and the fixed portion 420 have structures same as those of the connector 100 of the first embodiment. Accordingly, detailed explanation thereabout is omitted.

As shown in FIGS. 9, 12 and 13, each of the extending portions 460A of the present embodiment has a substantially plate-like shape intersecting with the first horizontal direction. In the second horizontal direction, the extending portions 460A of the present embodiment extend outward from opposite ends, respectively, of the lock spring portion 430. Each of the extending portions 460A is supported by the lock spring portion 430. Each of the extending portions 460A is positioned above the bottom surface 325 of the holding member 300A in the up-down direction. The extending portion 460A is accommodated in the accommodating portion 305A of the holding member 300A. The extending portion 460A is positioned outward beyond the second partition 330A of the holding member 300A in the first horizontal direction.

As shown in FIGS. 9, 12 and 13, the extending portion 460A of the present embodiment is provided with the regulated portion 470A. More specifically, the regulated portion 470A of the present embodiment is an upper surface of the extending portion 460A. Specifically, the connector 100A of the present embodiment has four of the regulated portions 470A. The regulated portion 470A is supported by the lock spring portion 430. The regulated portions 470A are accommodated in the accommodating portions 305A, respectively, of the holding member 300A. Specifically, the holding member 300A is provided with the accommodating portions 305A which accommodate the regulated portions 470A, respectively. The regulated portion 470A is positioned outward beyond the second partition 330A of the holding member 300A in the first horizontal direction.

Referring to FIGS. 9 and 14, each of the second members 500A of the present embodiment is made of conductor. Each of the second members 500A has a second attached portion 510 and a deformation-preventing portion 530A. As for the components of the second member 500A, the second attached portion 510 has a structure same as that of the second member 500 of the connector 100 of the aforementioned first embodiment. Accordingly, detailed explanation thereabout is omitted.

As shown in FIGS. 9 and 14, the deformation-preventing portion 530A of the present embodiment extends downward in the up-down direction from the second attached portion 510. The deformation-preventing portion 530A has an outer portion 531. The outer portion 531 defines an outer end of the deformation-preventing portion 530A in the first horizontal direction. The outer portion 531 has a regulating portion 532A. More specifically, the regulating portion 532A is a lower end of the outer portion 531. In other words, the deformation-preventing portion 530A is provided with the regulating portion 532A. The connector 100A of the present embodiment has four of the regulating portions 532A. The accommodating portions 305A of the holding member 300A are positioned below the regulating portions 532A, respectively, in the up-down direction. The regulated portion 470A of the first member 400A is positioned below the regulating portion 532A of the outer portion 531 of the deformation-preventing portion 530A of the second member 500A in the up-down direction. More specifically, in the connector 100A of the present embodiment, the four regulated portions 470A correspond to the four regulating portions 532A, respectively, and each of the regulated portions 470A is positioned below the corresponding regulating portion 532A in the up-down direction. The regulating portion 532A is positioned outward beyond the second partition 330A of the holding member 300A in the first horizontal direction. The regulating portion 532A is positioned above the second partition 330A of the holding member 300A in the up-down direction.

Movements of the components of the connector 100A upon the mating connector 700 being forced to be unmated from the connector 100A under a mated state where the connector 100A is mated with the mating connector 700 are described in detail hereinafter.

Referring to FIGS. 7 to 9 and 14, when the mating connector 700 is forced to be unmated from the connector 100A under the mated state where the connector 100A is mated with the mating connector 700, the lock spring portion 430 of the first member 400A of the connector 100A is resiliently deformed so that each of the lock portion 450 and the regulated portion 470A of the first member 400A of the connector 100A is moved in a combined direction of upward in the up-down direction and the first horizontal direction. More specifically, when the mating connector 700 is forced to be unmated from the connector 100A under the mated state where the connector 100A is mated with the mating connector 700, the lock spring portion 430 of the first member 400A of the connector 100A is resiliently deformed so that each of the lock portion 450 and the regulated portion 470A of the first member 400A of the connector 100A is moved in a combined direction of upward in the up-down direction and inward in the first horizontal direction.

In other words, the first member 400A of the present embodiment is configured so that, when the mating connector 700 is forced to be unmated from the connector 100A under the mated state where the connector 100A is mated with the mating connector 700, the lock spring portion 430 is resiliently deformed so that each of the lock portion 450 and the regulated portion 470A is moved in the combined direction of upward in the up-down direction and the first horizontal direction.

If the lock spring portion 430 is about to be excessively deformed under this case, the regulated portion 470A of the first member 400A abuts against the regulating portion 532A of the outer portion 531 of the deformation-preventing portion 530A of the second member 500A, so that the regulating portion 532A of the outer portion 531 of the deformation-preventing portion 530A of the second member 500A regulates the movement of the regulated portion 470A of the first member 400A. More specifically, if the lock spring portion 430 is about to be excessively deformed under this case, the regulated portion 470A of the first member 400A abuts from below against the regulating portion 532A of the outer portion 531 of the deformation-preventing portion 530A of the second member 500A in the up-down direction, so that the regulating portion 532A of the outer portion 531 of the deformation-preventing portion 530A of the second member 500A regulates the upward movement of the regulated portion 470A of the first member 400A.

Specifically, if the lock spring portion 430 is about to be excessively deformed when the mating connector 700 is forced to be unmated from the connector 100A under the mated state where the connector 100A is mated with the mating connector 700, the regulated portion 470A abuts against the regulating portion 532A so that the regulating portion 532A regulates the movement of the regulated portion 470A. In other words, a range of the movement of the regulated portion 470A is defined by the regulating portion 532A. More specifically, if the lock spring portion 430 is about to be excessively deformed when the mating connector 700 is forced to be unmated from the connector 100A under the mated state where the connector 100A is mated with the mating connector 700, the regulated portion 470A abuts from below against the regulating portion 532A in the up-down direction so that the regulating portion 532A regulates the movement of the regulated portion 470A. In other words, an upper limit of the range of the movement of the regulated portion 470A is defined by the regulating portion 532A.

As described above, similar to the connector 100 of the first embodiment, the connector 100A of the present embodiment is configured so that the first side wall 310, to which the first attached portion 410 of the first member 400A is attached, is perpendicular to the first horizontal direction while the second side wall 320, to which the second attached portion 510 of the second member 500A is attached, is perpendicular to the second horizontal direction. Thus, as compared with a case where the first side wall 310 and the second side wall 320 are aligned with each other, the regulated portion 470A can abut against the regulating portion 532A with large contact area when the lock spring portion 430 is about to be excessively deformed upon the mating connector 700 being unmated from the connector 100A under the mated state where the connector 100A is mated with the mating connector 700.

Similar to the connector 100 of the first embodiment, the connector 100A of the present embodiment is configured so that, when the mating connector 700 is forced to be unmated from the connector 100A under the mated state where the connector 100A is mated with the mating connector 700, each of the lock portion 450 and the regulated portion 470A is moved inward in the first horizontal direction. Accordingly, the second member 500A of the connector 100A of the present embodiment can be arranged inward of the lock spring portion 430 of the first member 400A in a direction in which the lock spring portion 430 is deformed when the mating connector 700 is forced to be unmated from the connector 100A. Thus, the connector 100A can be easily configured.

Third Embodiment

Figure 15:
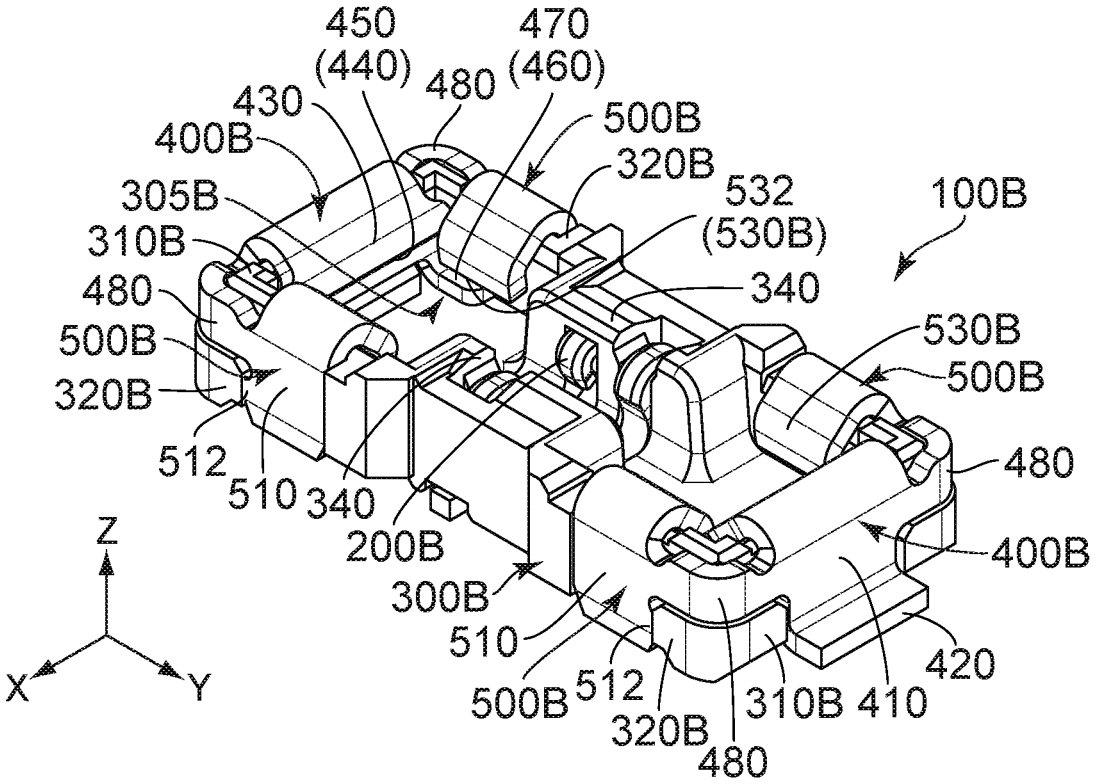
FIG. 15 is a perspective view showing a connector according to a third embodiment of the present invention.
Figure 16:
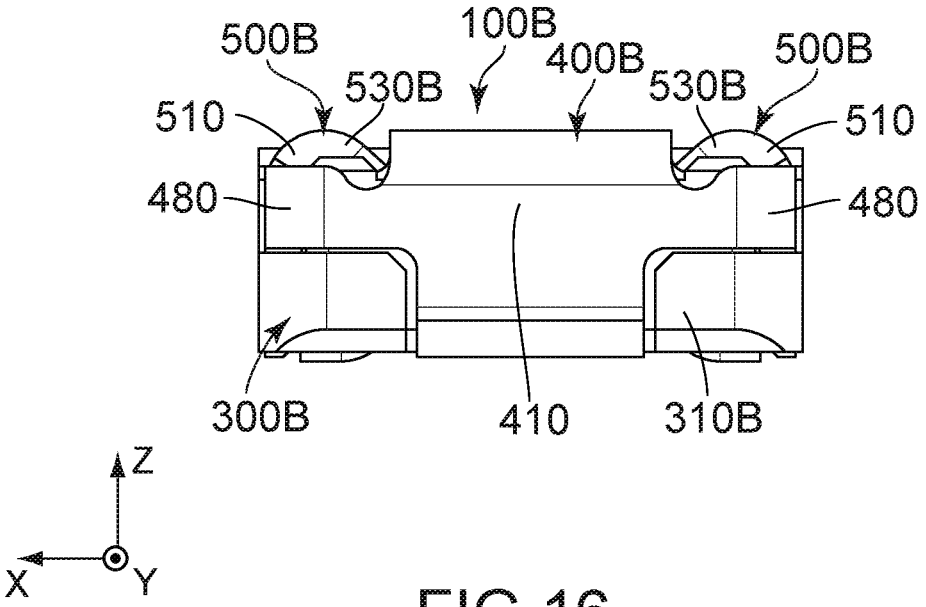
FIG. 16 is a front view showing the connector of FIG. 15.
Figure 19:
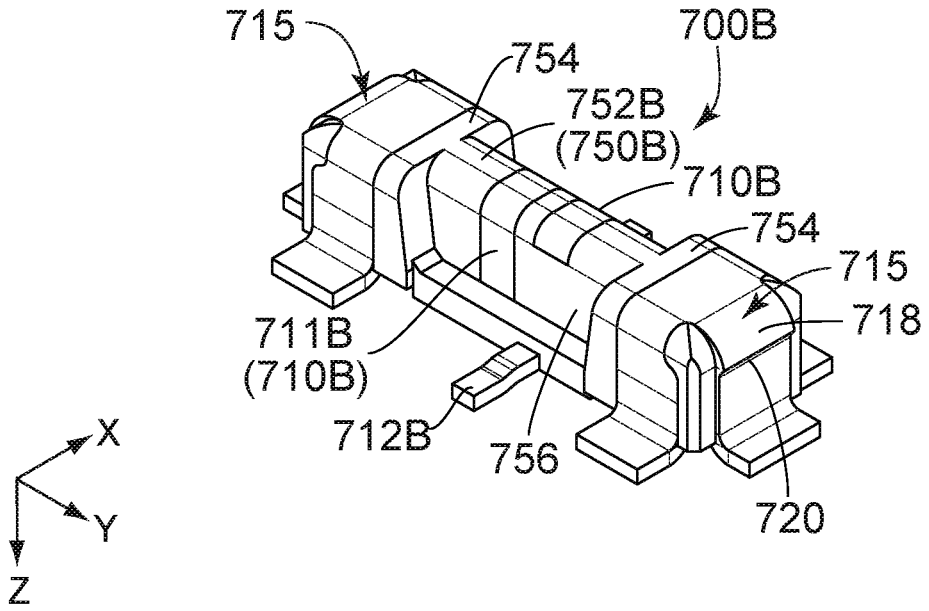
FIG. 19 is a perspective view showing a mating connector according to the third embodiment of the present invention.

Referring to FIGS. 15 and 19, a connector assembly according to a third embodiment of the present invention comprises a connector 100B and a mating connector 700B.

Referring to FIGS. 15 and 18 to 20, the connector 100B according to the third embodiment of the present invention is mateable with the mating connector 700B according to the third embodiment of the present invention in the up-down direction. Specifically, the connector 100B of the present embodiment is a receptacle, while the mating connector 700B of the present embodiment is a plug. As for directions and orientations in the present embodiment, expressions same as those of the first embodiment will be used hereinbelow. A method of mating the connector 100B with the mating connector 700B is described later.

Figure 20:
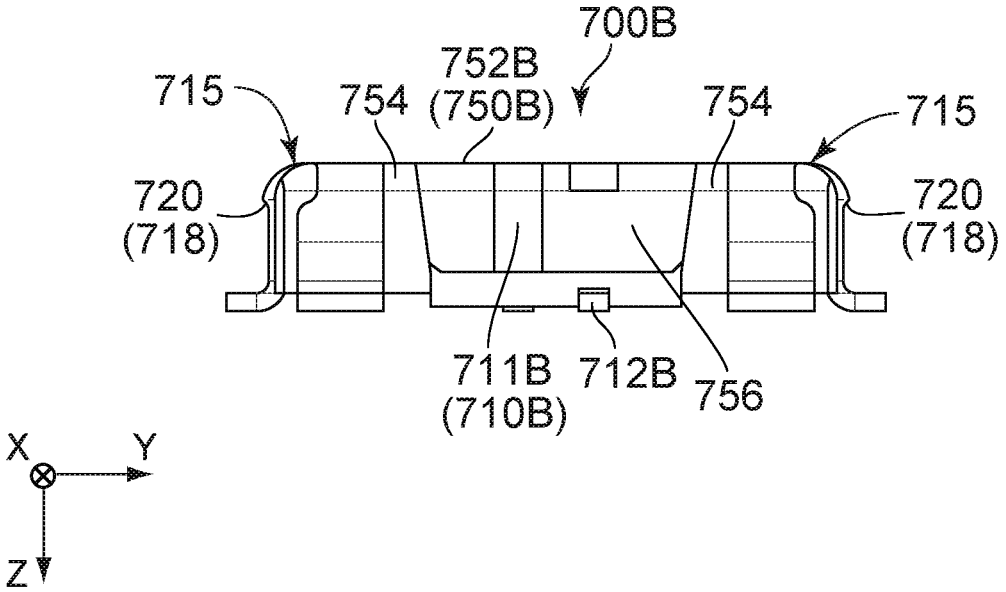
FIG. 20 is a side view showing the mating connector of FIG. 19.

As shown in FIGS. 19 and 20, the mating connector 700B of the present embodiment is provided with a mating holding member 750B, two mating terminals 710B and two lock members 715.

As shown in FIGS. 19 and 20, the mating holding member 750B of the present embodiment has an end surface 752B which faces downward in the up-down direction. The mating holding member 750B has two lock member holding portions 754 and a mating terminal holding portion 756.

As shown in FIGS. 19 and 20, each of the lock member holding portions 754 has a substantially cubic shape. The lock member holding portions 754 are positioned at opposite ends, respectively, of the mating terminal holding portion 756 in the first horizontal direction. Each of the lock member holding portions 754 has an outer surface which faces in the first horizontal direction.

As shown in FIGS. 19 and 20, the mating terminal holding portion 756 of the present embodiment couples the two lock member holding portions 754 with each other in the first horizontal direction. The mating terminal holding portion 756 has two outer surfaces each facing in the second horizontal direction.

As shown in FIGS. 19 and 20, each of the mating terminals 710B of the present embodiment has a contact portion 711B and a fixed portion 712B. The contact portion 711B of the present embodiment has a plate-like shape perpendicular to the second horizontal direction. The contact portion 711B is held by the outer surface, which faces in the second horizontal direction, of the mating terminal holding portion 756 of the mating holding member 750B. The fixed portion 712B of the present embodiment extends outward in the second horizontal direction from the mating terminal holding portion 756 of the mating holding member 750B.

As shown in FIGS. 19 and 20, the lock member 715 of the present embodiment is held by the outer surface, which faces in the first horizontal direction, of the lock member holding portion 754 of the mating holding member 750B. The lock member 715 has a structure similar to the lock member 715 of the mating connector 700 of the first embodiment. Accordingly, the portions which are same as those of the lock member 715 are referred by using reference signs same as those of the lock member 715, and detailed explanation about the same portions is omitted.

As shown in FIG. 15, the connector 100B of the present embodiment comprises a holding member 300B, two terminals 200B, two first members 400B and four second members 500B.

Figure 18:
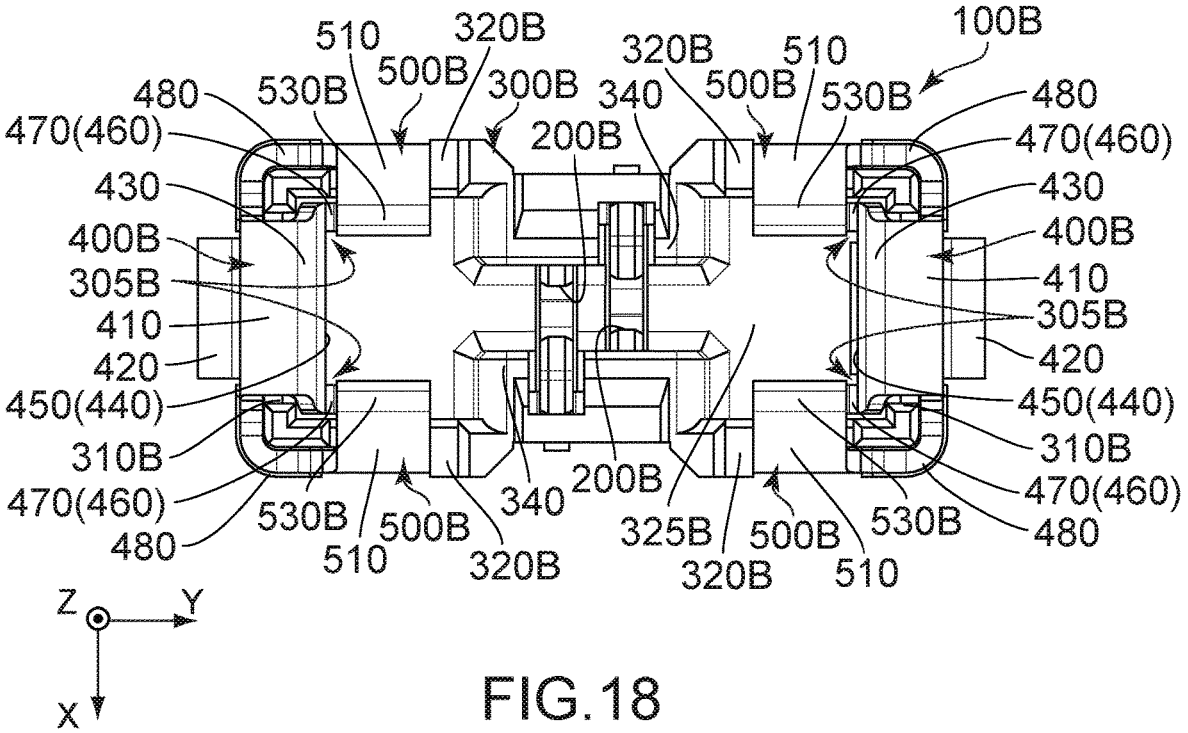
FIG. 18 is a top view showing the connector of FIG. 15.

Referring to FIG. 18, the holding member 300B of the present embodiment is made of insulator. The holding member 300B has two first side walls 310B, four second side walls 320B, two third side walls 340 and a bottom surface 325B. However, the present embodiment is not limited thereto. It is sufficient that the holding member 300B has at least the first side wall 310B and the second side wall 320B.

As shown in FIG. 18, the first side walls 310B are positioned at opposite ends, respectively, of the holding member 300B in the first horizontal direction. Each of the first side walls 310B of the present embodiment intersects with the first horizontal direction which is perpendicular to the up-down direction. More specifically, each of the first side walls 310B is perpendicular to the first horizontal direction.

Figure 17:
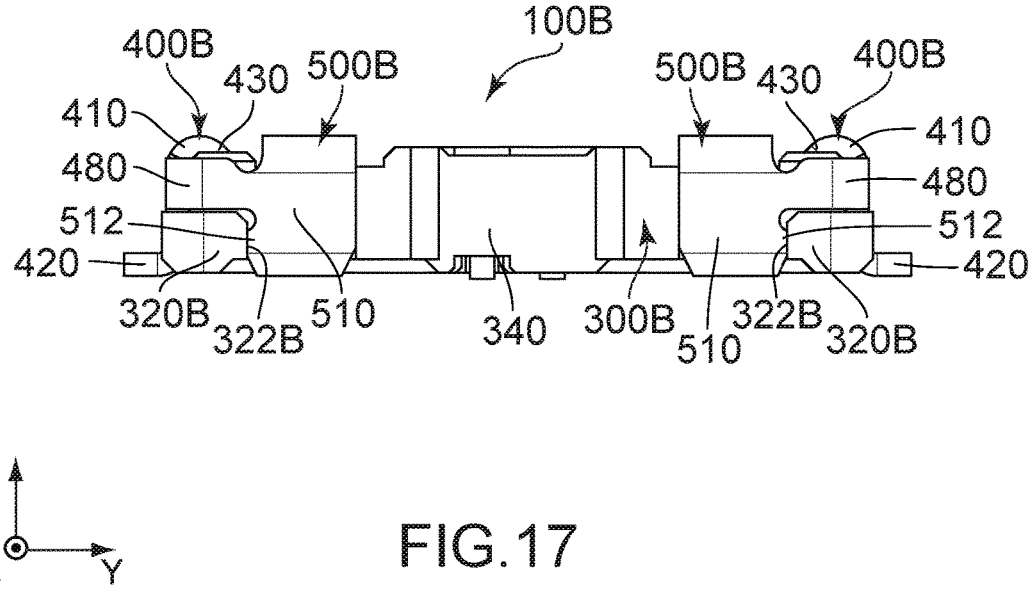
FIG. 17 is a side view showing the connector of FIG. 15.

As shown in FIG. 18, the second side walls 320B of the present embodiment are positioned at opposite ends of the holding member 300B in the second horizontal direction. Each of the second side walls 320B of the present embodiment intersects with the second horizontal direction which is perpendicular to both the up-down direction and the first horizontal direction. More specifically, each of the second side walls 320B is perpendicular to the second horizontal direction. The second side wall 320B extends inward in the first horizontal direction from an outer end of the first side wall 310B in the second horizontal direction. The outer end of the first side wall 310B in the second horizontal direction is connected with an outer end of the second side wall 320B in the first horizontal direction. As shown in FIG. 17, the second side wall 320B has a second press-fitted portion 322B into which a second press-fit portion 512 of a second attached portion 510 of the second member 500B is press-fit.

As shown in FIGS. 15 and 18, the third side wall 340 is connected with the second side wall 320B. Specifically, in the first horizontal direction, an outer end of the third side wall 340 is connected with an inner end of the second side wall 320B.

As shown in FIG. 18, the bottom surface 325B of the present embodiment has a plate-like shape which is perpendicular to the up-down direction. The bottom surface 325B is connected with a lower end of each of the first side walls 310B, the second side walls 320B and the third side walls 340.

As shown in FIGS. 15 and 18, the holding member 300B of the present embodiment is provided with four accommodating portions 305B. Each of the accommodating portions 305B is positioned above the bottom surface 325B in the up-down direction. The accommodating portion 305B is positioned in the vicinity of a connection portion at which the first side wall 310B and the second side wall 320B are connected with each other.

As shown in FIGS. 15 and 18, the holding member 300B of the present embodiment holds the terminals 200B, the first members 400B and the second members 500B. More specifically, the terminals 200B are held by the third side walls 340, respectively, of the holding member 300B. The first members 400B are held by the first side walls 310B, respectively, of the holding member 300B. The second members 500B are held by the second side walls 320B, respectively, of the holding member 300B.

Referring to FIG. 18, each of the terminals 200B of the present embodiment is made of conductor. Specifically, each of the terminals 200B is distinct and separated from the second member 500B. In other words, the second member 500B of the present embodiment does not function as the terminal 200B. Referring to FIGS. 15 and 19, the terminals 200B of the present embodiment are connected with the mating terminals 710B, respectively, when the connector 100B is mated with the mating connector 700B.

Referring to FIGS. 15 to 18, each of the first members 400B of the present embodiment is made of conductor. Each of the first members 400B has a first attached portion 410, a lock spring portion 430, a protrusion 440, a lock portion 450, two extending portions 460, two regulated portions 470, a fixed portion 420 and coupling portions 480. The first member 400B has a structure similar to the structure of the first member 400 of the first embodiment except for the coupling portion 480. Accordingly, components similar to those of the first embodiment among components of the third embodiment will be designated by the same reference numerals as those of the first embodiment, and detail explanation thereabout will be omitted.

As shown in FIGS. 15 to 18, the coupling portions 480 of the present embodiment are positioned at opposite ends, respectively, of the first member 400B in the second horizontal direction. The coupling portion 480 couples the first member 400B and the second member 500B with each other. Specifically, in the present embodiment of the connector 100B, the first member 400B is integrally formed with the second member 500B.

Referring to FIGS. 15 and 18, each of the second members 500B of the present embodiment is made of conductor. Each of the second members 500B has the second attached portion 510 and a deformation-preventing portion 530B. As for the components of the second member 500B, the second attached portion 510 has a structure same as the second attached portion 510 of the first embodiment. Accordingly, detailed explanation thereabout is omitted. The deformation-preventing portion 530B of the present embodiment has a structure similar to that of the deformation-preventing portion 530 of the first embodiment except that the deformation-preventing portion 530B does not function as the terminal 200B. Accordingly, components similar to those of the first embodiment among components of the third embodiment will be designated by the same reference numerals as those of the first embodiment, and detail explanation thereabout will be omitted.

A method of mating the connector 100B with the mating connector 700B is described below.

Referring to FIGS. 15 and 18 to 20, the connector 100B and the mating connector 700B are positioned so that the bottom surface 325B of the holding member 300B of the connector 100B faces the end surface 752B of the mating holding member 750B of the mating connector 700B in the up-down direction while the protrusions 440 of the lock spring portions 430 of the first members 400B of the connector 100B face protrusions 718 of the lock members 715, respectively, of the mating connector 700B in the up-down direction. At this time, the mating terminals 710B of the mating connector 700B are positioned above the terminals 200B, respectively, of the connector 100B in the up-down direction.

Next, when the mating connector 700B is moved downward relative to the connector 100B, the protrusion 440 of the lock spring portion 430 of each of the first members 400B of the connector 100B is brought into contact with the protrusion 718 of the corresponding lock member 715 of the mating connector 700B.

After that, when the mating connector 700B is further moved downward relative to the connector 100B, the lock spring portion 430 of each of the first members 400B of the connector 100B is resiliently deformed outward in the first horizontal direction so that the protrusion 440 is moved outward in the first horizontal direction. When the mating connector 700B continues to be moved downward in this state, the lock portion 450 of the protrusion 440 of each of the first members 400B of the connector 100B reaches a position same as a position of a locked portion 720 of the protrusion 718 of the corresponding lock member 715 of the mating connector 700B in the up-down direction.

At this time, the lock spring portion 430 of the first member 400B of the connector 100B restores its original shape while the protrusion 440 returns to its original position in the first horizontal direction. Meanwhile, the lock portion 450 of the protrusion 440 of each of the first members 400B of the connector 100B faces the locked portion 720 of the protrusion 718 of the corresponding lock member 715 of the mating connector 700B in the up-down direction. In other words, the connector 100B and the mating connector 700B are in a mated state where the connector 100B is mated with the mating connector 700B. In addition, each of the terminals 200B of the connector 100B is in contact with the contact portion 711B of the corresponding mating terminal 710B of the mating connector 700B under that state. In other words, the terminals 200B of the connector 100B are connected with the mating terminals 710B, respectively, of the mating connector 700B.

Movements of the components of the connector 100B upon the mating connector 700B being forced to be unmated from the connector 100B under the mated state where the connector 100B is mated with the mating connector 700B are described in detail hereinafter.

Referring to FIGS. 15 and 18 to 20, when the mating connector 700B is forced to be unmated from the connector 100B under the mated state where the connector 100B is mated with the mating connector 700B, the lock spring portion 430 of the first member 400B of the connector 100B is resiliently deformed so that each of the lock portion 450 and the regulated portion 470 of the first member 400B of the connector 100B is moved in a combined direction of upward in the up-down direction and the first horizontal direction. More specifically, when the mating connector 700B is forced to be unmated from the connector 100B under the mated state where the connector 100B is mated with the mating connector 700B, the lock spring portion 430 of the first member 400B of the connector 100B is resiliently deformed so that each of the lock portion 450 and the regulated portion 470 of the first member 400B of the connector 100B is moved in a combined direction of upward in the up-down direction and inward in the first horizontal direction.

In other words, the first member 400B of the present embodiment is configured so that, when the mating connector 700B is forced to be unmated from the connector 100B under the mated state where the connector 100B is mated with the mating connector 700B, the lock spring portion 430 is resiliently deformed so that each of the lock portion 450 and the regulated portion 470 is moved in the combined direction of upward in the up-down direction and the first horizontal direction.

If the lock spring portion 430 is about to be excessively deformed under this case, the regulated portion 470 of the first member 400B abuts against a regulating portion 532 of the deformation-preventing portion 530B of the second member 500B, so that the regulating portion 532 of the deformation-preventing portion 530B of the second member 500B regulates the movement of the regulated portion 470 of the first member 400B. More specifically, if the lock spring portion 430 is about to be excessively deformed under this case, the regulated portion 470 of the first member 400B abuts from below against the regulating portion 532 of the deformation-preventing portion 530B of the second member 500B in the up-down direction, so that the regulating portion 532 of the deformation-preventing portion 530B of the second member 500B regulates the upward movement of the regulated portion 470 of the first member 400B.

Specifically, if the lock spring portion 430 is about to be excessively deformed when the mating connector 700B is forced to be unmated from the connector 100B under the mated state where the connector 100B is mated with the mating connector 700B, the regulated portion 470 abuts against the regulating portion 532 so that the regulating portion 532 regulates the movement of the regulated portion 470. In other words, a range of the movement of the regulated portion 470 is defined by the regulating portion 532. More specifically, if the lock spring portion 430 is about to be excessively deformed when the mating connector 700B is forced to be unmated from the connector 100B under the mated state where the connector 100B is mated with the mating connector 700B, the regulated portion 470 abuts from below against the regulating portion 532 in the up-down direction so that the regulating portion 532 regulates the movement of the regulated portion 470. In other words, an upper limit of the range of the movement of the regulated portion 470 is defined by the regulating portion 532.

As described above, the connector 100B of the present embodiment is configured so that the first side wall 310B, to which the first attached portion 410 of the first member 400B is attached, is perpendicular to the first horizontal direction while the second side wall 320B, to which the second attached portion 510 of the second member 500B is attached, is perpendicular to the second horizontal direction. Thus, as compared with a case where the first side wall 310B and the second side wall 320B are aligned with each other, the regulated portion 470 can abut against the regulating portion 532 with large contact area when the lock spring portion 430 is about to be excessively deformed upon the mating connector 700B being unmated from the connector 100B under the mated state where the connector 100B is mated with the mating connector 700B.

Similar to the connector 100, 100A of the aforementioned embodiments, the connector 100B of the present embodiment is configured so that, when the mating connector 700B is forced to be unmated from the connector 100B under the mated state where the connector 100B is mated with the mating connector 700B, each of the lock portion 450 and the regulated portion 470 is moved inward in the first horizontal direction. Accordingly, the second member 500B of the connector 100B of the present embodiment can be arranged inward of the lock spring portion 430 of the first member 400 in a direction in which the lock spring portion 430 is deformed when the mating connector 700B is forced to be unmated from the connector 100B. Thus, the connector 100B can be easily configured.

The structures of the first member 400B and the second member 500B of the connector 100B are not limited thereto. For example, the first member 400B and the second member 500B can be modified as described below.

As shown in FIGS. 21 to 24, a first member 400C of a first modification of the present embodiment has a first attached portion 410, a lock spring portion 430, a protrusion 440, a lock portion 450, two extending portions 460C, two regulated portions 470C and two coupling portions 480. The first member 400C has a structure similar to the structure of the first member 400B of the third embodiment except for the extending portion 460C and the regulated portion 470C. Accordingly, components similar to those of the third embodiment among components of the first modification will be designated by the same reference numerals as those of the third embodiment, and detail explanation thereabout will be omitted. A relation between the first member 400C and the holding member 300B is similar to that of the third embodiment. Accordingly, detailed explanation thereabout is omitted.

Figure 24:
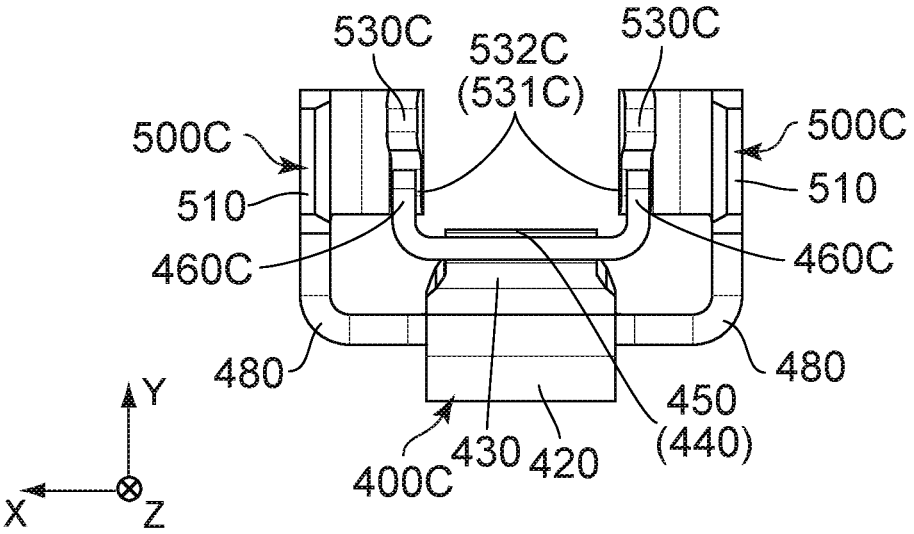
FIG. 24 is a bottom view showing the first member and the second member of FIG. 21.
Figure 25:
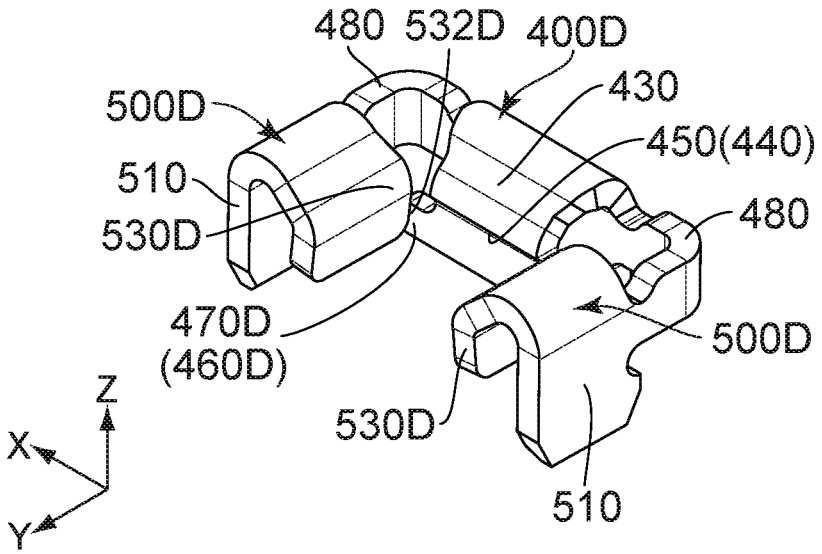
FIG. 25 is a perspective view showing a second modification of the first member and the second member which are included in the connector of FIG. 15.
Figure 26:
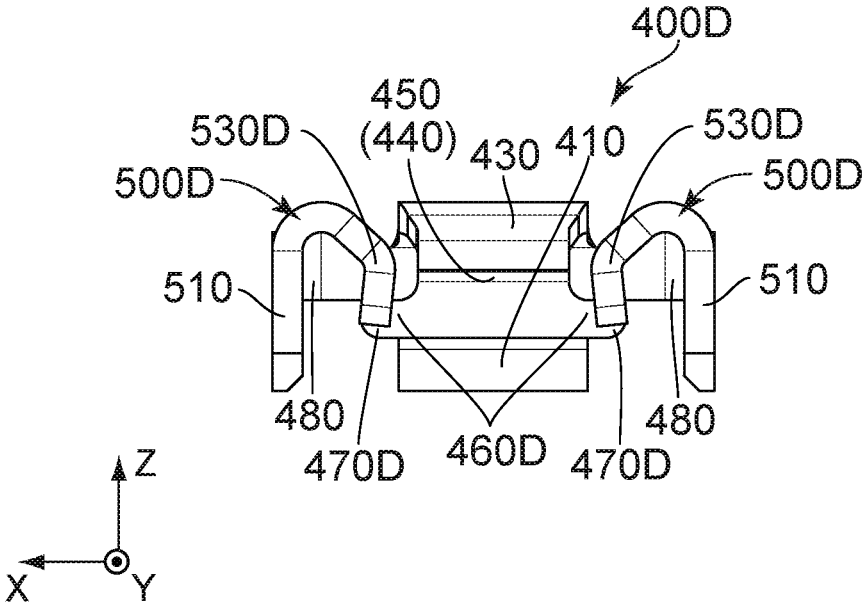
FIG. 26 is a front view showing the first member and the second member of FIG. 25.
Figure 27:
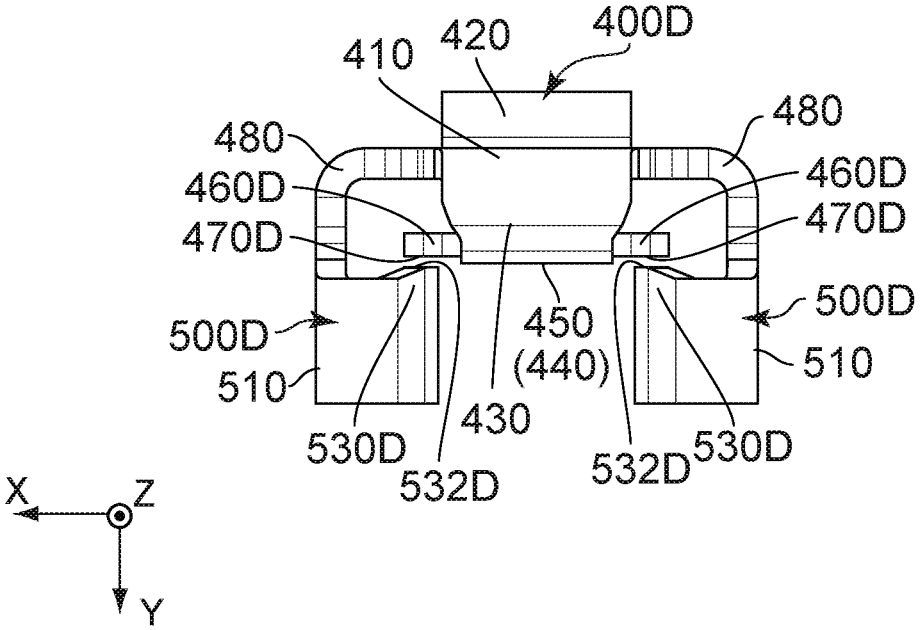
FIG. 27 is a top view showing the first member and the second member of FIG. 25.
Figure 28:
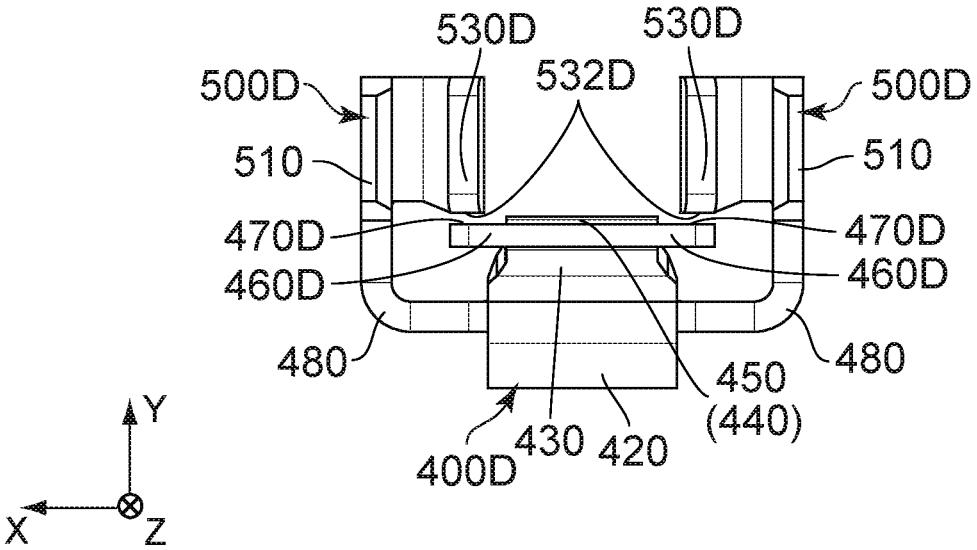
FIG. 28 is a bottom view showing the first member and the second member of FIG. 25.

As shown in FIG. 24, each of the extending portions 460C of the present modification has a substantially L-like shape when viewed along the up-down direction. The extending portions 460C extend inward in the first horizontal direction from opposite ends, respectively, of the lock spring portion 430 in the second horizontal direction. The extending portion 460C is accommodated in the accommodating portion 305B which is provided in the holding member 300B.

Figure 21:
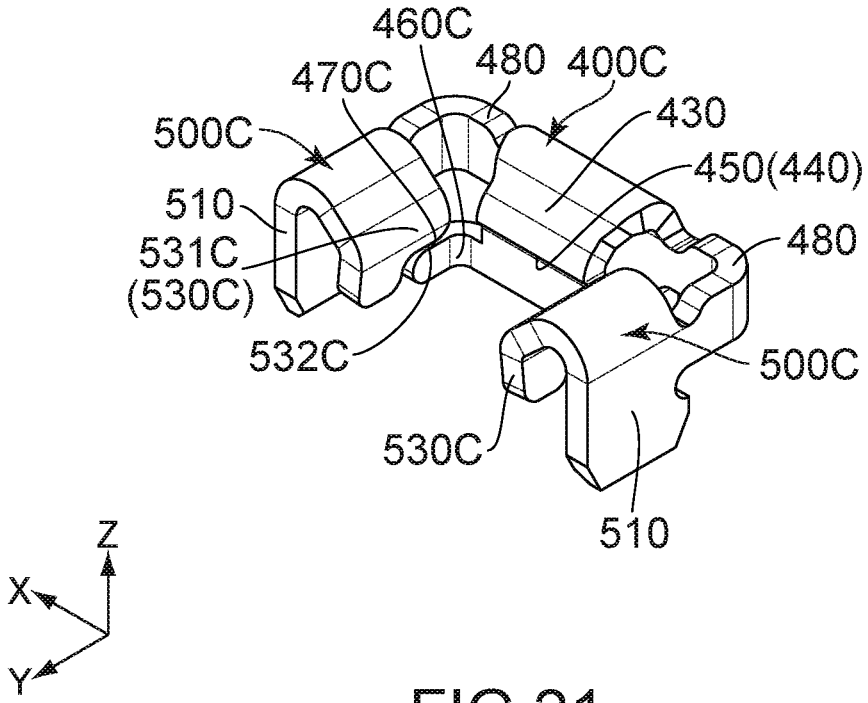
FIG. 21 is a perspective view showing a first modification of a first member and a second member which are included in the connector of FIG. 15.
Figure 22:
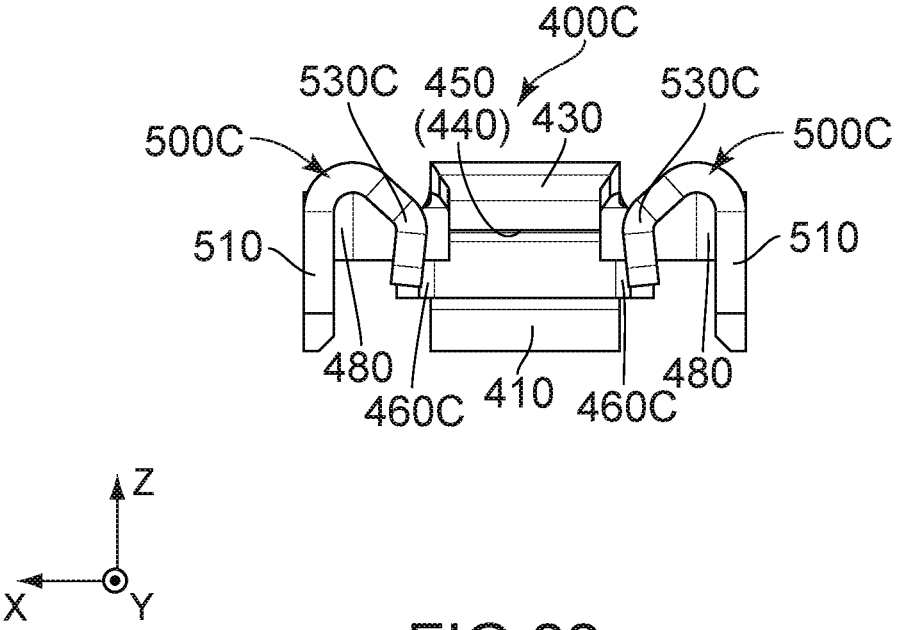
FIG. 22 is a front view showing the first member and the second member of FIG. 21.
Figure 23:
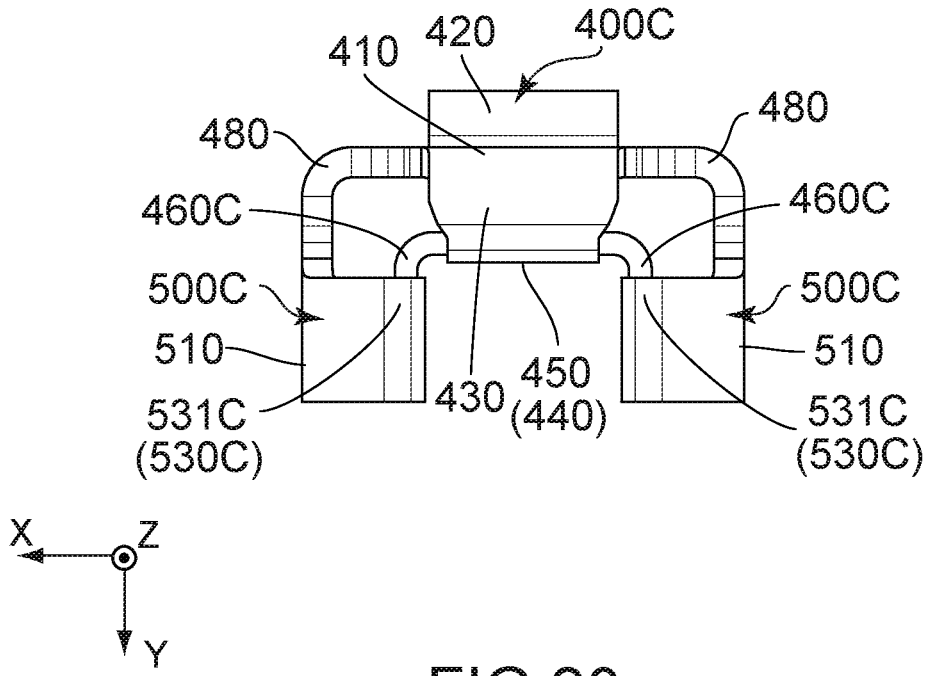
FIG. 23 is a top view showing the first member and the second member of FIG. 21.

Referring to FIG. 21, each of the extending portions 460C of the present modification is provided with the regulated portion 470C. More specifically, the regulated portion 470C is an upper surface of the extending portion 460C. The regulated portion 470C is accommodated in the accommodating portion 305B which is provided in the holding member 300B.

As shown in FIGS. 21 to 24, a second member 500C of the first modification of the present invention has a second attached portion 510 and a deformation-preventing portion 530C. As for the components of the second member 500C, the second attached portion 510 has a structure same as the second attached portion 510 of the third embodiment. Accordingly, detailed explanation thereabout is omitted. A relation between the second member 500C and the holding member 300B is similar to that of the third embodiment. Accordingly, detailed explanation thereabout is omitted.

As shown in FIG. 21, the deformation-preventing portion 530C of the present modification extends downward in the up-down direction from the second attached portion 510. The deformation-preventing portion 530C has an outer portion 531C. The outer portion 531C defines an outer end of the deformation-preventing portion 530C in the first horizontal direction. The outer portion 531C has a regulating portion 532C. More specifically, the regulating portion 532C is a lower end of the outer portion 531C. In other words, the deformation-preventing portion 530C of the present embodiment is provided with the regulating portion 532C. The regulated portion 470C of the first member 400C is positioned below the regulating portion 532C of the outer portion 531C of the deformation-preventing portion 530C of the second member 500C in the up-down direction.

A method of mating a connector (not shown), which comprises the first members 400C and the second members 500C, with the mating connector 700B is similar to that of the aforementioned third embodiment. Accordingly, detailed explanation thereabout is omitted.

Movements of the components of the connector (not shown), which comprises the first members 400C and the second members 500C, upon the mating connector 700B being forced to be unmated from the connector under a mated state where the connector is mated with the mating connector 700B are similar to those of the aforementioned third embodiment. Accordingly, detailed explanation thereabout is omitted.

As shown in FIGS. 25 to 28, a first member 400D of a second modification of the present invention has a first attached portion 410, a lock spring portion 430, a protrusion, a lock portion 450, two extending portions 460D, two regulated portions 470D and a coupling portion 480. The first member 400D has a structure similar to that of the third embodiment except for the extending portion 460D and the regulated portion 470D. Accordingly, components similar to those of the third embodiment among components of the second modification will be designated by the same reference numerals as those of the third embodiment, and detail explanation thereabout will be omitted. A relation between the first member 400D and the holding member 300B is similar to that of the third embodiment. Accordingly, detailed explanation thereabout is omitted.

As shown in FIGS. 25 to 28, each of the extending portions 460D of the present modification has a substantially plate-like shape which intersects with the first horizontal direction. In the second horizontal direction, the extending portions 460D of the present embodiment extend outward from opposite ends, respectively, of the lock spring portion 430. Each of the extending portions 460D is supported by the lock spring portion 430. The extending portion 460D is accommodated in the accommodating portion 305B which is provided in the holding member 300B.

As shown in FIGS. 25 to 28, each of the extending portions 460D of the present embodiment is provided with the regulated portion 470D. More specifically, the regulated portion 470D of the present embodiment is an inner surface of the extending portion 460D in the first horizontal direction. The regulated portion 470D is supported by the lock spring portion 430. The regulated portion 470D is accommodated in the accommodating portion 305B which is provided in the holding member 300B.

As shown in FIGS. 25 to 28, a second member 500D of the second modification of the present invention has a second attached portion 510 and a deformation-preventing portion 530D. As for the components of the second member 500D, the second attached portion 510 has a structure same as that of the third embodiment. Accordingly, detailed explanation thereabout is omitted. A relation between the second member 500D and the holding member 300B is similar to that of the third embodiment except for a regulating portion 532D. Accordingly, detailed explanation thereabout is omitted.

As shown in FIGS. 25 to 28, the deformation-preventing portion 530D of the present modification extends downward in the up-down direction from the second attached portion 510. The deformation-preventing portion 530D is provided with the regulating portion 532D. More specifically, the regulating portion 532D of the present modification is a part of an outer end surface of the deformation-preventing portion 530D in the first horizontal direction. The regulating portion 532D is positioned in the vicinity of a lower end of the deformation-preventing portion 530D. The regulated portion 470D of the first member 400D faces the regulating portion 532D of the second member 500D in the first horizontal direction. More specifically, the regulated portion 470D of the first member 400D is positioned outward beyond the regulating portion 532D of the second member 500D in the first horizontal direction. The accommodating portion 305B, which is provided in the holding member 300B, neighbors to the regulating portion 532D of the deformation-preventing portion 530D of the second member 500D in the first horizontal direction. More specifically, in the first horizontal direction, the accommodating portion 305B is positioned outward beyond the regulating portion 532D of the deformation-preventing portion 530D of the second member 500D and neighbors to the regulating portion 532D.

A method of mating a connector (not shown), which comprises the first members 400D and the second members 500D, with the mating connector 700B is similar to that of the third embodiment. Accordingly, detailed explanation thereabout is omitted.

Movements of the components of the connector (not shown), which comprising the first members 400D and the second members 500D, upon the mating connector 700B being forced to be unmated from the connector under a mated state where the connector is mated with the mating connector 700B are described in detail hereinafter.

Referring to FIGS. 25 to 28, when the mating connector 700B is forced to be unmated from the connector, which comprises the first members 400D and the second members 500D, under the mated state where the connector is mated with the mating connector 700B, the lock spring portion 430 of the first member 400D of the connector is resiliently deformed so that each of the lock portion 450 and the regulated portion 470D of the first member 400D of the connector is moved in a combined direction of upward in the up-down direction and the first horizontal direction. More specifically, when the mating connector 700B is forced to be unmated from the connector under the mated state where the connector is mated with the mating connector 700B, the lock spring portion 430 of the first member 400D of the connector is resiliently deformed so that each of the lock portion 450 and the regulated portion 470D of the first member 400D of the connector is moved in a combined direction of upward in the up-down direction and inward in the first horizontal direction.

In other words, the first member 400D of the present embodiment is configured so that, when the mating connector 700B is forced to be unmated from the connector under the mated state where the connector is mated with the mating connector 700B, the lock spring portion 430 is resiliently deformed so that each of the lock portion 450 and the regulated portion 470D is moved in the combined direction of upward in the up-down direction and the first horizontal direction.

If the lock spring portion 430 is about to be excessively deformed under this case, the regulated portion 470D of the first member 400D abuts against the regulating portion 532D of the deformation-preventing portion 530D of the second member 500D, so that the regulating portion 532D of the deformation-preventing portion 530D of the second member 500D regulates the movement of the regulated portion 470D of the first member 400D. More specifically, if the lock spring portion 430 is about to be excessively deformed under this case, the regulated portion 470D of the first member 400D abuts from outside against the regulating portion 532D of the deformation-preventing portion 530D of the second member 500D in the first horizontal direction, so that the regulating portion 532D of the deformation-preventing portion 530D of the second member 500D regulates the inward movement of the regulated portion 470D of the first member 400D in the first horizontal direction.

Specifically, if the lock spring portion 430 is about to be excessively deformed when the mating connector 700B is forced to be unmated from the connector, which comprises the first members 400D and the second members 500D, under the mated state where the connector is mated with the mating connector 700B, the regulated portion 470D abuts against the regulating portion 532D so that the regulating portion 532D regulates the movement of the regulated portion 470D. In other words, a range of the movement of the regulated portion 470D is defined by the regulating portion 532D. More specifically, if the lock spring portion 430 is about to be excessively deformed when the mating connector 700B is forced to be unmated from the connector under the mated state where the connector is mated with the mating connector 700B, the regulated portion 470D abuts against the regulating portion 532D in the first horizontal direction so that the regulating portion 532D regulates the movement of the regulated portion 470D. In other words, the range of the movement of the regulated portion 470D in the first horizontal direction is defined by the regulating portion 532D.

Fourth Embodiment

Figure 29:
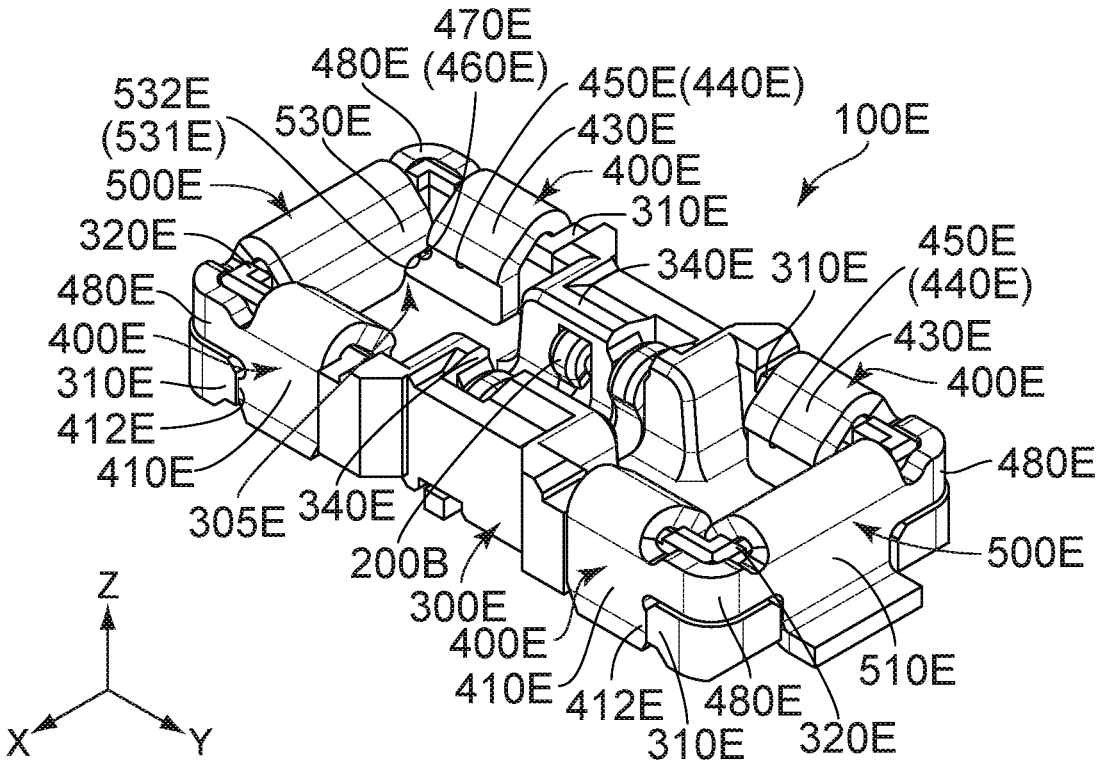
FIG. 29 is a perspective view showing a connector according to a fourth embodiment of the present invention.
Figure 32:
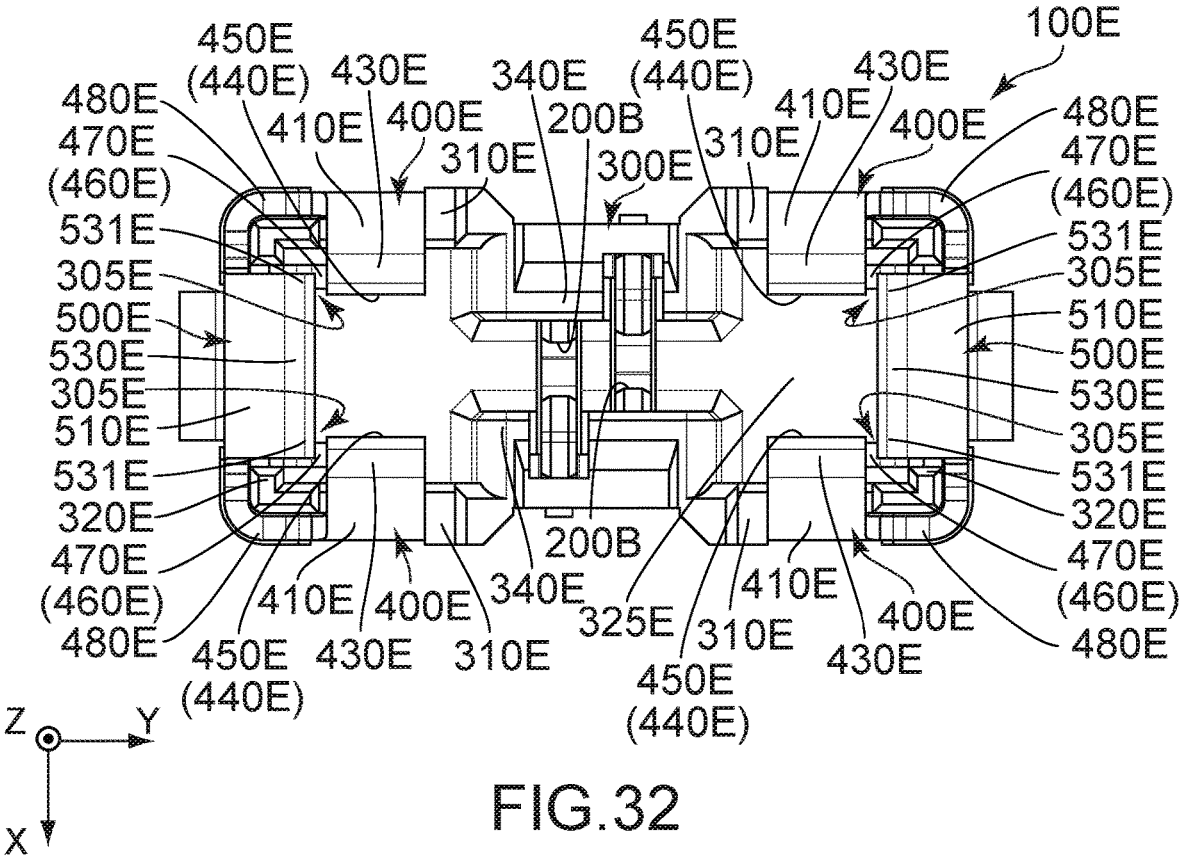
FIG. 32 is a top view showing the connector of FIG. 29.

Referring to FIGS. 29 and 32, a connector assembly according to a fourth embodiment of the present invention comprises a connector 100E and a mating connector (not shown).

Referring to FIGS. 29 and 32, the connector 100E according to the fourth embodiment of the present invention is mateable with the mating connector (not shown) of the present invention in an up-down direction. Specifically, the connector 100E of the present embodiment is a receptacle, while the mating connector of the present embodiment is a plug. In the present embodiment, the up-down direction is a Z-direction. It is assumed that upward is a positive Z-direction while downward is a negative Z-direction. A method of mating the connector 100E with the mating connector is similar to the method of mating the connector 100B with the mating connector 700B of the aforementioned third embodiment except for numbers and arrangements of lock portions and locked portions. Accordingly, detailed explanation thereabout is omitted.

As shown in FIG. 29, the connector 100E of the present embodiment comprises a holding member 300E, two terminals 200B, four first members 400E and two second members 500E. The terminal 200B has a structure same as that of the third embodiment. Accordingly, detailed explanation thereabout is omitted.

Referring FIG. 29, the holding member 300E of the present embodiment is made of insulator. The holding member 300E has four first side walls 310E, two second side walls 320E, two third side walls 340E and a bottom surface 325E. However, the present invention is not limited thereto. It is sufficient that the holding member 300E has at least the first side wall 310E and the second side wall 320E.

Figure 31:
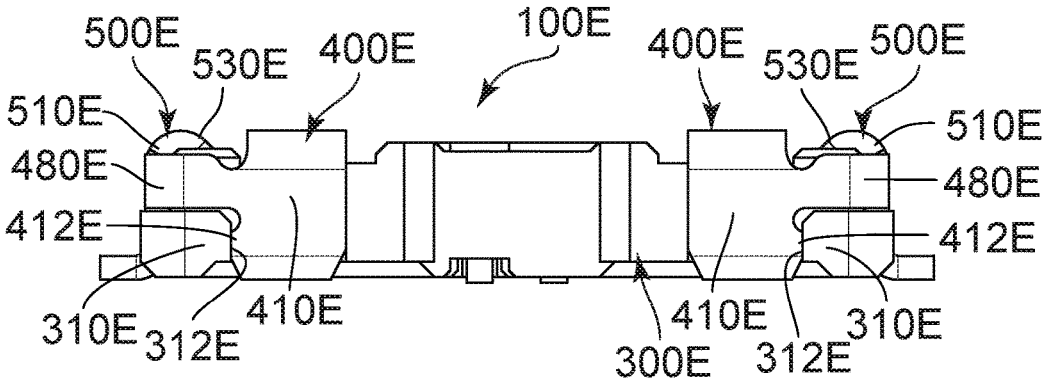
FIG. 31 is a side view showing the connector of FIG. 29.
Figure 31:
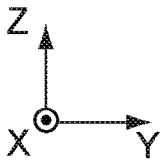

As shown in FIGS. 31 and 32, the first side walls 310E of the present embodiment are positioned at opposite ends of the holding member 300E in a first horizontal direction. Each of the first side walls 310E of the present embodiment intersects with the first horizontal direction which is perpendicular to the up-down direction. More specifically, each of the first side walls 310E is perpendicular to the first horizontal direction. Each of the first side walls 310E extends inward in a second horizontal direction from an outer end of the second side wall 320E in the first horizontal direction. An outer end of the first side wall 310E in the second horizontal direction is connected with the outer end of the second side wall 320E in the first horizontal direction. As shown in FIG. 31, the first side wall 310E has a first press-fitted portion 312E. In the present embodiment, the first horizontal direction is an X-direction, while the second horizontal direction is a Y-direction.

Figure 30:
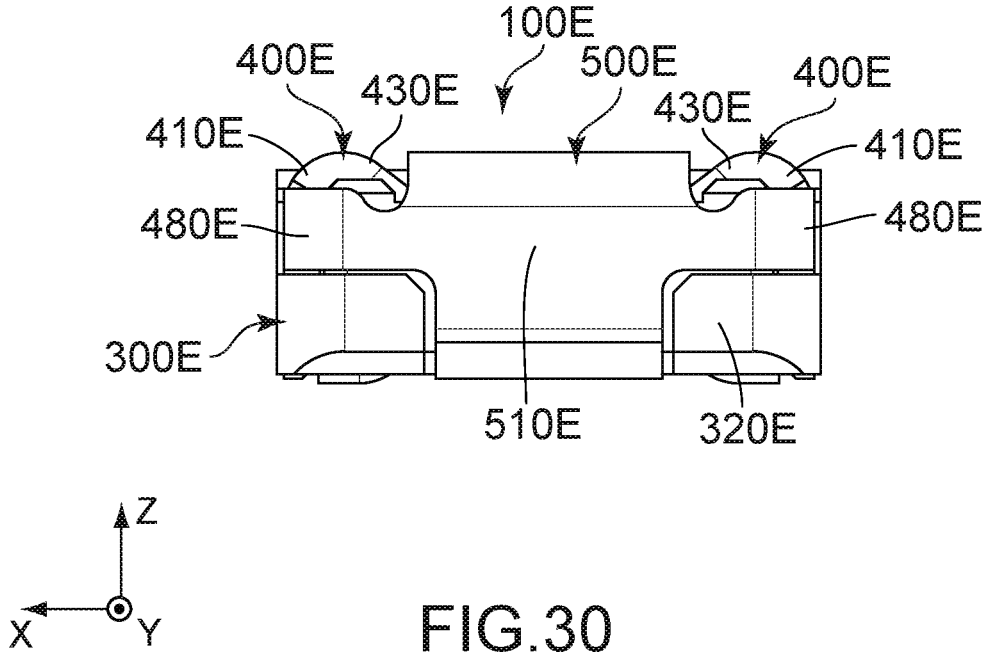
FIG. 30 is a front view showing the connector of FIG. 29.

As shown in FIGS. 30 and 32, the second side walls 320E of the present embodiment are positioned at opposite ends, respectively, of the holding member 300E in the second horizontal direction. Each of the second side walls 320E of the present embodiment intersects with the second horizontal direction which is perpendicular to both the up-down direction and the first horizontal direction. More specifically, each of the second side walls 320E is perpendicular to the second horizontal direction. Each of the second side walls 320E extends inward in the first horizontal direction from the outer end of the first side wall 310E in the second horizontal direction.

As shown in FIGS. 29 and 32, the third side wall 340E of the present embodiment is connected with the first side wall 310E. Specifically, in the second horizontal direction, an outer end of the third side wall 340E is connected with an inner end of the first side wall 310E.

As shown in FIGS. 29 and 32, the bottom surface 325E of the present embodiment has a plate-like shape which is perpendicular to the up-down direction. The bottom surface 325E is connected with a lower end of each of the first side walls 310E, the second side walls 320E and the third side walls 340E.

As shown in FIG. 32, the holding member 300E of the present embodiment is provided with four accommodating portions 305E. Each of the accommodating portions 305E is positioned above the bottom surface 325E. The accommodating portion 305E is positioned in the vicinity of a connecting portion at which the first side wall 310E and the second side wall 320E are connected with each other.

As shown in FIGS. 29 and 32, the holding member 300E of the present embodiment holds the terminals 200B, the first members 400E and the second members 500E. More specifically, the terminals 200B are held by the third side walls 340E, respectively, of the holding member 300E. The first members 400E are held by the first side walls 310E, respectively, of the holding member 300E. The second members 500E are held by the second side walls 320E, respectively, of the holding member 300E.

As shown in FIGS. 29 to 32, the first member 400E has a first attached portion 410E, a lock spring portion 430E, a protrusion 440E, a lock portion 450E, an extending portion 460E, a regulated portion 470E and a coupling portion 480E.

As shown in FIGS. 29 and 31, the first attached portion 410E of the present embodiment extends in the up-down direction. The first attached portion 410E has a first press-fit portion 412E which extends outward in the second horizontal direction. The first attached portion 410E of the present embodiment is attached to the first side wall 310E of the holding member 300E. More specifically, the first press-fit portion 412E of the first attached portion 410E of each of the first members 400E is press-fit into the first press-fitted portion 312E of the corresponding first side wall 310E.

As shown in FIGS. 29 and 31, the lock spring portion 430E of the present embodiment extends in the first horizontal direction and downward in the up-down direction from the first attached portion 410E. More specifically, the lock spring portion 430E of the present embodiment extends inward in the first horizontal direction and downward in the up-down direction from the first attached portion 410E.

As shown in FIGS. 29 and 32, the protrusion 440E of the present embodiment protrudes inward in the first horizontal direction from the lock spring portion 430E. Specifically, the protrusion 440E is supported by the lock spring portion 430E. The protrusion 440E has the lock portion 450E. More specifically, the lock portion 450E is a lower surface of the protrusion 440E.

As shown in FIGS. 29 to 32, the lock portion 450E of the present embodiment is supported by the lock spring portion 430E. The lock portions 450E of the present embodiment lock a mated state, where the connector 100E is mated with the mating connector, together with the locked portions, respectively, of lock members when the connector 100E is mated with the mating connector (not shown).

As shown in FIGS. 29 and 32, the extending portion 460E of the present embodiment has a substantially plate-like shape which intersects with the first horizontal direction. In the second horizontal direction, the extending portion 460E of the present embodiment extends outward from an outer end of the lock spring portion 430E. The extending portion 460E is supported by the lock spring portion 430E. The extending portion 460E is positioned above the bottom surface 325E of the holding member 300E in the up-down direction. The extending portion 460E of the first members 400E is accommodated in the accommodating portions 305E of the holding member 300E.

As shown in FIGS. 29 and 32, each of the extending portions 460E of the present embodiment is provided with the regulated portion 470E. More specifically, the regulated portion 470E of the present embodiment is an upper surface of the extending portion 460E. In other words, the connector 100E of the present embodiment has four of the regulated portions 470E. The regulated portion 470E is supported by the lock spring portion 430E. The regulated portions 470E are accommodated in the accommodating portions 305E, respectively, of the holding member 300E. In other words, the holding member 300E is provided with the accommodating portions 305E each accommodating the corresponding regulated portion 470E.

As shown in FIGS. 29 to 32, two of the first members 400E and one of the second members 500E form a pair while remaining two of the first members 400E and a remaining one of the second members 500E from another pair. In each pair, the coupling portions 480E of the first members 400E are positioned at opposite ends, respectively, of the second member 500E in the first horizontal direction. In each pair, the coupling portion 480E couples the first member 400E and the second member 500E with each other. In other words, the first member 400E and the second member 500E of the present embodiment are integrally formed with each other.

As shown in FIGS. 29 and 32, each of the second members 500E of the present embodiment has a second attached portion 510E and a deformation-preventing portion 530E.

As shown in FIGS. 29 and 32, the second attached portion 510E of the present embodiment extends in the up-down direction. The second attached portion 510E of the present embodiment is attached to the second side wall 320E of the holding member 300E.

As shown in FIGS. 29 and 32, the deformation-preventing portion 530E of the present embodiment extends downward in the up-down direction from the second attached portion 510E. The deformation-preventing portion 530E has outer portions 531E. The outer portions 531E define opposite outer ends, respectively, of the deformation-preventing portion 530E in the first horizontal direction. Each of the outer portions 531E has a regulating portion 532E. More specifically, the regulating portion 532E is a lower end of the outer portion 531E. In other words, the deformation-preventing portion 530E is provided with the regulating portions 532E. The connector 100E of the present embodiment has four of the regulating portions 532E. The accommodating portions 305E correspond to the regulating portions 532E, respectively. Each of the accommodating portions 305E of the holding member 300E is positioned below the corresponding regulating portion 532E of the outer portion 531E of the deformation-preventing portion 530E of the second member 500E in the up-down direction. The regulated portion 470E of the first member 400E is positioned below the regulating portion 532E of the outer portion 531E of the deformation-preventing portion 530E of the second member 500E in the up-down direction. More specifically, in the connector 100E of the present embodiment, the four regulated portions 470E correspond to the four regulating portions 532E, respectively, and each of the regulated portions 470E is positioned below the corresponding regulating portion 532E in the up-down direction.

Movements of the components of the connector 100E upon the mating connector being forced to be unmated from the connector 100E under the mated state where the connector 100E is mated with the mating connector are described in detail hereinafter.

Referring to FIGS. 29 and 32, when the mating connector is forced to be unmated from the connector 100E under the mated state where the connector 100E is mated with the mating connector, the lock spring portion 430E of the first member 400E of the connector 100E is resiliently deformed so that each of the lock portion 450E and the regulated portion 470E of the first member 400E of the connector 100E is moved in a combined direction of upward in the up-down direction and the first horizontal direction. More specifically, when the mating connector is forced to be unmated from the connector 100E under the mated state where the connector 100E is mated with the mating connector, the lock spring portion 430E of the first member 400E of the connector 100E is resiliently deformed so that each of the lock portion 450E and the regulated portion 470E of the first member 400E of the connector 100E is moved in a combined direction of upward in the up-down direction and inward in the first horizontal direction.

In other words, the first member 400E of the present embodiment is configured so that, when the mating connector is forced to be unmated from the connector 100E under the mated state where the connector 100E is mated with the mating connector, the lock spring portion 430E is resiliently deformed so that each of the lock portion 450E and the regulated portion 470E is moved in the combined direction of upward in the up-down direction and the first horizontal direction.

If the lock spring portion 430E is about to be excessively deformed under this case, the regulated portion 470E of the first member 400E abuts against the regulating portion 532E of the outer portion 531E of the deformation-preventing portion 530E of the second member 500E, so that the regulating portion 532E of the outer portion 531E of the deformation-preventing portion 530E of the second member 500E regulates the movement of the regulated portion 470E of the first member 400E. More specifically, if the lock spring portion 430E is about to be excessively deformed under this case, the regulated portion 470E of the first member 400E abuts from below against the regulating portion 532E of the outer portion 531E of the deformation-preventing portion 530E of the second member 500E in the up-down direction, so that the regulating portion 532E of the outer portion 531E of the deformation-preventing portion 530E of the second member 500E regulates the upward movement of the regulated portion 470E of the first member 400E.

Specifically, if the lock spring portion 430E is about to be excessively deformed when the mating connector is forced to be unmated from the connector 100E under the mated state where the connector 100E is mated with the mating connector, the regulated portion 470E abuts against the regulating portion 532E so that the regulating portion 532E regulates the movement of the regulated portion 470E. In other words, a range of the movement of the regulated portion 470E is defined by the regulating portion 532E. More specifically, if the lock spring portion 430E is about to be excessively deformed when the mating connector is forced to be unmated from the connector 100E under the mated state where the connector 100E is mated with the mating connector, the regulated portion 470E abuts from below against the regulating portion 532E in the up-down direction so that the regulating portion 532E regulates the movement of the regulated portion 470E. In other words, an upper limit of the range of the movement of the regulated portion 470E is defined by the regulating portion 532E.

Similar to the aforementioned connectors 100, 100A and 100B, the connector 100E of the present embodiment is configured so that the first side wall 310E, to which the first attached portion 410E of the first member 400E is attached, is perpendicular to the first horizontal direction while the second side wall 320E, to which the second attached portion 510E of the second member 500E is attached, is perpendicular to the second horizontal direction. Thus, as compared with a case where the first side wall 310E and the second side wall 320E are aligned with each other, the regulated portion 470E can abut against the regulating portion 532E with large contact area when the lock spring portion 430E is about to be excessively deformed upon the mating connector being unmated from the connector 100E under the mated state where the connector 100 is mated with the mating connector.

Similar to the connectors 100, 100A and 100B of the aforementioned embodiments, the connector 100E of the present embodiment is configured so that, when the mating connector is forced to be unmated from the connector 100E under the mated state where the connector 100E is mated with the mating connector, each of the lock portion 450E and the regulated portion 470E is moved inward in the first horizontal direction. Accordingly, the second member 500E of the connector 100E of the present embodiment can be arranged inward of the lock spring portion 430E of the first member 400E in a direction in which the lock spring portion 430E is deformed when the mating connector is forced to be unmated from the connector 100E. Thus, the connector 100E can be easily configured.

Fifth Embodiment

Figure 33:
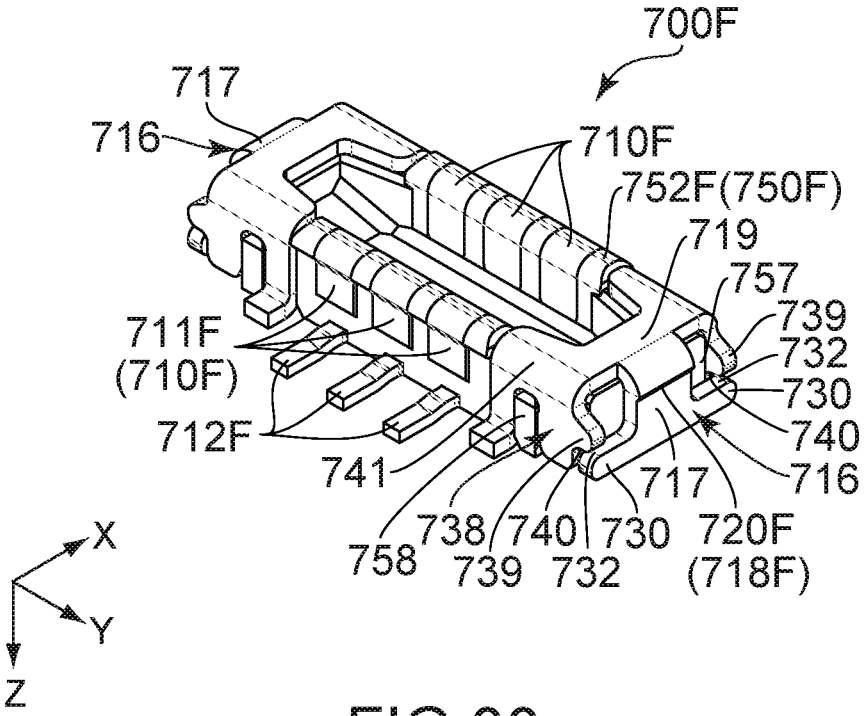
FIG. 33 is a perspective view showing a connector according to a fifth embodiment of the present invention.
Figure 34:
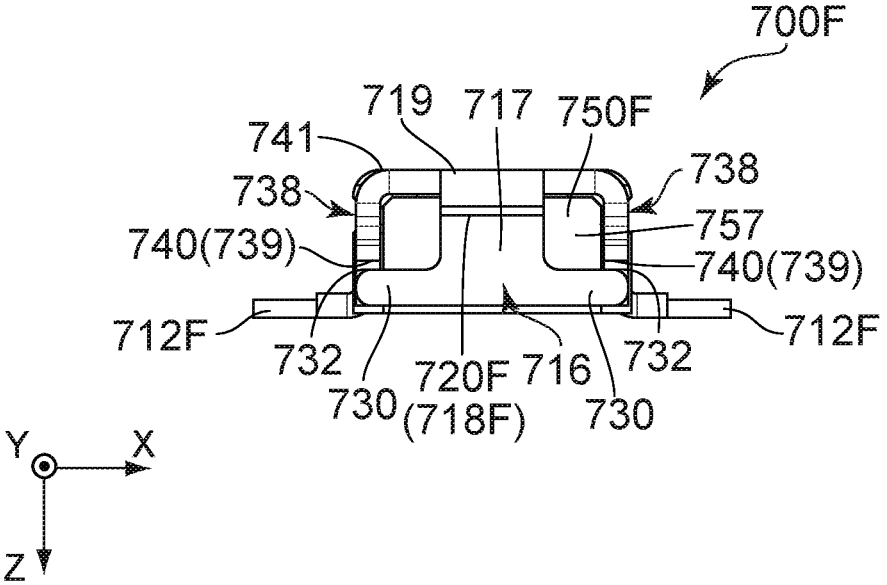
FIG. 34 is a front view showing the connector of FIG. 33.
Figure 35:
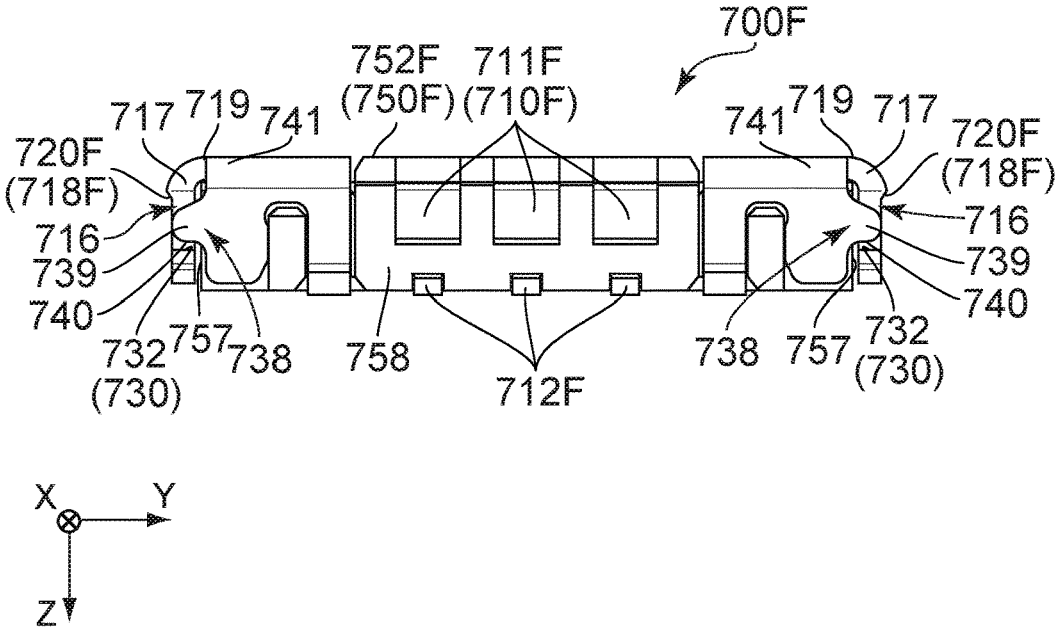
FIG. 35 is a side view showing the connector of FIG. 33.
Figure 36:
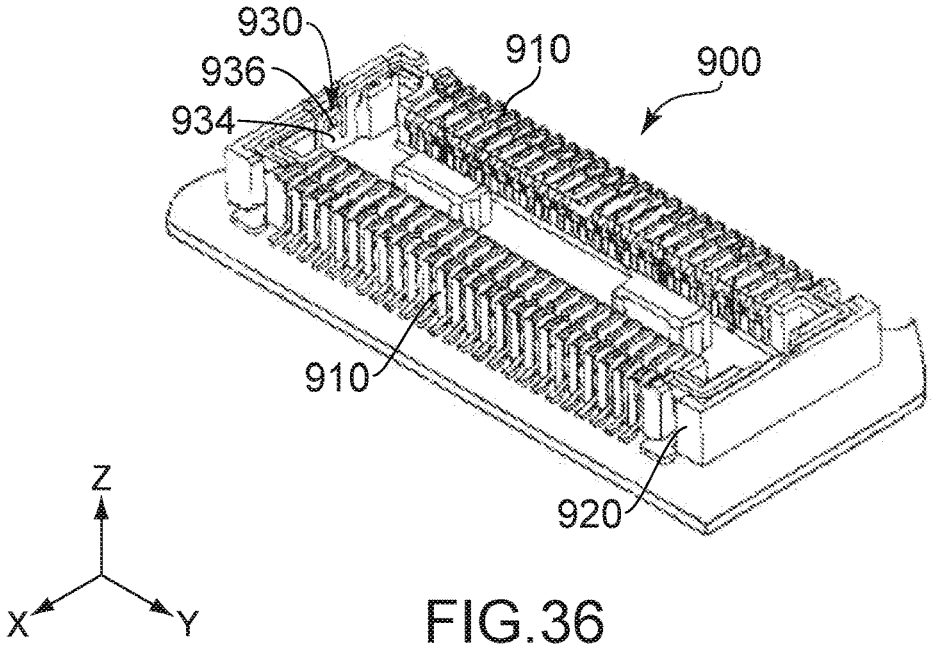
FIG.36 PRIOR ART
FIG. 36 is a perspective view showing a connector of Patent Document 1.
Figure 37:
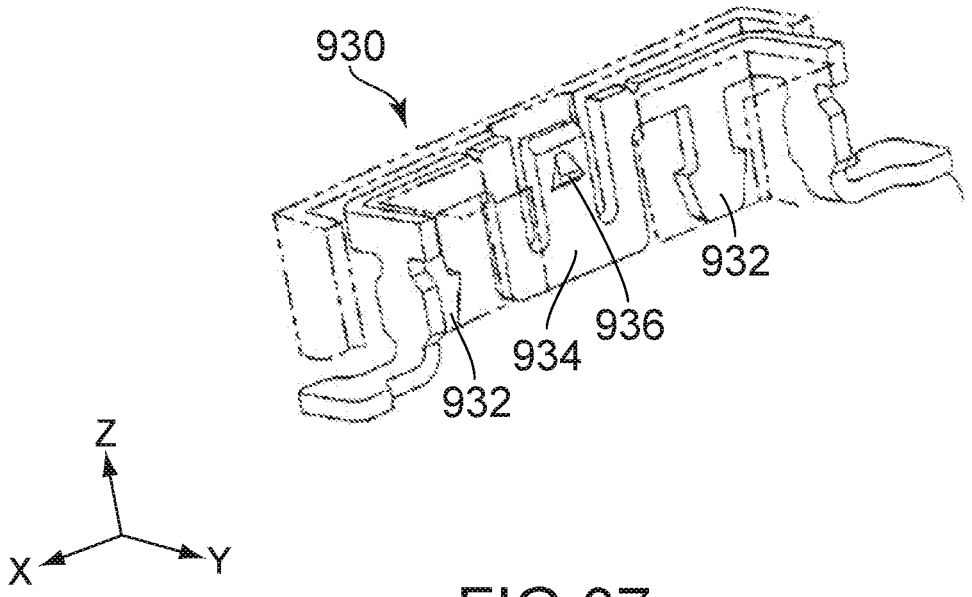
FIG.37 PRIOR ART
FIG. 37 is a perspective view showing a lock member which is included in the connector of FIG. 36.
Figure 38:
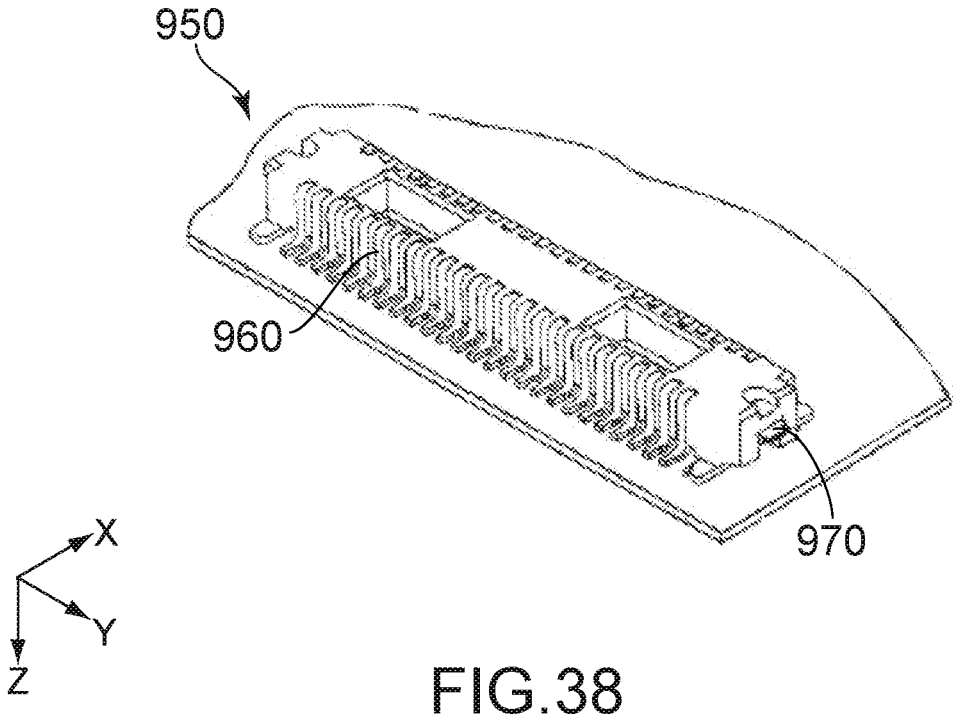
FIG.38 PRIOR ART
FIG. 38 is a perspective view showing a mating connector of Patent Document 1.

Referring to FIGS. 33 to 35, a connector assembly according to a fifth embodiment of the present invention comprises a connector 700F and a mating connector (not shown).

Referring to FIGS. 33 to 35, the connector 700F of the fifth embodiment of the present invention is mateable with the mating connector (not shown) of the present embodiment of the present invention in an up-down direction. Specifically, the connector 700F of the present embodiment is a plug, while the mating connector of the present embodiment is a receptacle. In the present embodiment, the up-down direction is a Z-direction. It is assumed that upward is a negative Z-direction while downward is a positive Z-direction. A method of mating the connector 700F with the mating connector is described later.

The mating connector (not shown) of the present embodiment has a mating holding member having an upper surface, mating terminals and lock members. Each of the lock members of the present embodiment has a protrusion. The protrusion protrudes inward in a first horizontal direction and has a locked portion. More specifically, the locked portion is an upper surface of the protrusion. In other words, the mating connector of the present embodiment is provided with the mating terminals and the locked portions. In the present embodiment, the first horizontal direction is a Y-direction.

As shown in FIGS. 33 to 35, the connector 700F of the present embodiment comprises a holding member 750F, terminals 710F, first members 716 and second members 738.

As shown in FIGS. 33 to 35, the holding member 750F of the present embodiment holds the terminals 710F, the first members 716 and the second members 738. The holding member 750F of the present embodiment has two first side walls 757, two second side walls 758 and an end surface 752F. However, the present invention is not limited thereto. It is sufficient that the holding member 750F has at least the first side wall 757 and the second side wall 758.

As shown in FIGS. 33 to 35, each of the first side walls 757 of the present embodiment intersects with the first horizontal direction which is perpendicular to the up-down direction. More specifically, each of the first side walls 757 is perpendicular to the first horizontal direction. Each of the second side walls 758 of the present embodiment intersects with a second horizontal direction which is perpendicular to both the up-down direction and the first horizontal direction. More specifically, each of the second side walls 758 is perpendicular to the second horizontal direction. In the present embodiment, the second horizontal direction is an X-direction.

As shown in FIGS. 33 to 35, the end surface 752F of the present embodiment is an upper end surface of the connector 700F.

As shown in FIGS. 33 to 35, the terminals 710F of the present embodiment are connected with the mating terminals (not shown), respectively, of the mating connector under a mated state where the connector 700F is mated with the mating connector (not shown). Each of the terminals 710F of the present embodiment is made of conductor. Each of the terminals 710F has a contact portion 711F and a fixed portion 712F. The contact portion 711F has a plate-like shape which is perpendicular to the second horizontal direction. The contact portion 711F is held by the second side wall 758 of the holding member 750F. The fixed portion 712F of the present embodiment has a plate-like shape which is perpendicular to the up-down direction. The fixed portion 712F extends outward in the second horizontal direction from the second side wall 758 of the holding member 750F.

As shown in FIGS. 33 to 35, each of the first members 716 of the present embodiment has a first attached portion 719, a lock spring portion 717, a protrusion 718F, a lock portion 720F, extending portions 730 and regulated portions 732.

As shown in FIGS. 33 to 35, the first attached portion 719 of the present embodiment is attached to the first side wall 757 of the holding member 750F.

As shown in FIGS. 33 to 35, the lock spring portion 717 of the present embodiment extends in the first horizontal direction and downward in the up-down direction from the first attached portion 719. More specifically, the lock spring portion 717 of the present embodiment extends outward in the first horizontal direction and downward in the up-down direction from the first attached portion 719.

Referring to FIGS. 33 to 35, the protrusion 718F of the present embodiment protrudes outward in the first horizontal direction from the lock spring portion 717. In other words, the protrusion 718F is supported by the lock spring portion 717. The protrusion 718F has the lock portion 720F. More specifically, the lock portion 720F is a lower surface of the protrusion 718F.

Referring to FIGS. 33 to 35, the lock portion 720F of the present embodiment is supported by the lock spring portion 717. The lock portions 720F of the present embodiment lock the mated state together with the locked portions, respectively, when the connector 700F is mated with the mating connector.

Referring to FIGS. 33 to 35, each of the extending portions 730 of the present embodiment has a plate-like shape intersecting with the first horizontal direction. In the second horizontal direction, the extending portions 730 of the present embodiment extend outward from lower ends of the lock spring portion 717 which are positioned at its opposite ends, respectively. Each of the extending portions 730 is supported by the lock spring portion 717.

As shown in FIGS. 33 to 35, each of the extending portions 730 of the present embodiment is provided with the regulated portion 732. More specifically, the regulated portion 732 of the present embodiment is an upper surface of the extending portion 730. In other words, the connector 700F of the present embodiment has four of the regulated portions 732. The regulated portion 732 is supported by the lock spring portion 717.

Referring to FIGS. 33 to 35, the second member 738 of the present embodiment has a second attached portion 741 and deformation-preventing portions 739.

Referring to FIGS. 33 to 35, the second attached portion 741 of the present embodiment is attached to the second side wall 758 of the holding member 750F.

Referring to FIGS. 33 to 35, each of the deformation-preventing portions 739 of the present embodiment extends downward in the up-down direction from the second attached portion 741. Each of the deformation-preventing portions 739 is provided with a regulating portion 740. More specifically, the regulating portion 740 is a lower surface of the deformation-preventing portion 739.

A method of mating the connector 700F with the mating connector is described below.

Referring to FIGS. 33 to 35, first, the connector 700F and the mating connector 700 are positioned so that the end surface 752F of the holding member 750F of the connector 700F faces the upper surface of the mating holding member of the mating connector in the up-down direction while the protrusions 718F of the lock spring portions 717 of the first members 716 of the connector 700F face the protrusions of the lock members, respectively, of the mating connector in the up-down direction. At this time, each of the terminals 710F of the connector 700F is positioned below the corresponding mating terminal of the mating connector in the up-down direction.

Next, when the mating connector is moved downward relative to the connector 700F, each of the protrusions 718F of the lock spring portions 717 of the first members 716 of the connector 700F is brought into abutment with the protrusion of the corresponding lock member of the mating connector.

After that, when the mating connector is further moved downward relative to the connector 700F, each of the lock spring portions 717 of the first members 716 of the connector 700F is resiliently deformed inward in the first horizontal direction while each of the protrusions 718F is moved inward in the first horizontal direction. When the mating connector continues to be moved downward in this state, the lock portion 720F of the protrusion 718F of each of the first members 716 of the connector 700F reaches a position same as a position of the locked portion of the protrusion of the corresponding lock member of the mating connector in the up-down direction.

At this time, the lock spring portion 717 of the first member 716 of the connector 700F restores its original shape while the protrusion 718F returns to its original position in the first horizontal direction. Meanwhile, the lock portion 720F of the protrusion 718F of each of the first members 716 of the connector 700F faces the locked portion of the protrusion of the corresponding lock member of the mating connector in the up-down direction. In other words, the connector 700F and the mating connector are in the mated state. In addition, the contact portion 711F of each of the terminals 710F of the connector 700F is in contact with a contact portion of the corresponding mating terminal of the mating connector under that state. In other words, the terminals 710F of the connector 700F are connected with the mating terminals, respectively, of the mating connector.

Movements of the components of the connector 700F upon the mating connector being forced to be unmated from the connector 700F under the mated state where the connector 700F is mated with the mating connector are described in detail hereinafter.

Referring to FIGS. 33 to 35, when the mating connector is forced to be unmated from the connector 700F under the mated state where the connector 700F is mated with the mating connector, the lock spring portion 717 is resiliently deformed so that each of the lock portion 720F and the regulated portion 732 is moved in a combined direction of upward in the up-down direction and the first horizontal direction. Specifically, when the mating connector is forced to be unmated from the connector 700F under the mated state where the connector 700F is mated with the mating connector, the lock spring portion 717 is resiliently deformed so that each of the lock portion 720F and the regulated portion 732 is moved in a combined direction of upward in the up-down direction and outward in the first horizontal direction.

In other words, the first member 716 of the present embodiment is configured so that, when the mating connector is forced to be unmated from the connector 700F under the mated state where the connector 700F is mated with the mating connector, the lock spring portion 717 is resiliently deformed so that each of the lock portion 720F and the regulated portion 732 is moved in the combined direction of upward in the up-down direction and the first horizontal direction.

If the lock spring portion 717 is about to be excessively deformed under this case, the regulated portion 732 of the first member 716 abuts against the regulating portion 740 of the deformation-preventing portion 739 of the second member 738, so that the regulating portion 740 of the deformation-preventing portion 739 of the second member 738 regulates the movement of the regulated portion 732 of the first member 716. More specifically, if the lock spring portion 717 is about to be excessively deformed under this case, the regulated portion 732 of the first member 716 abuts from below against the regulating portion 740 of the deformation-preventing portion 739 of the second member 738 in the up-down direction, so that the regulating portion 740 of the deformation-preventing portion 739 of the second member 738 regulates the upward movement of the regulated portion 732 of the first member 716.

Specifically, if the lock spring portion 717 is about to be excessively deformed when the mating connector is forced to be unmated from the connector 700F under the mated state where the connector 700F is mated with the mating connector, the regulated portion 732 abuts against the regulating portion 740 so that the regulating portion 740 regulates the movement of the regulated portion 732. In other words, a range of the movement of the regulated portion 732 is defined by the regulating portion 740. More specifically, if the lock spring portion 717 is about to be excessively deformed when the mating connector is forced to be unmated from the connector 700F under the mated state where the connector 700F is mated with the mating connector, the regulated portion 732 abuts from below against the regulating portion 740 in the up-down direction so that the regulating portion 740 regulates the movement of the regulated portion 732. In other words, an upper limit of the range of the movement of the regulated portion 732 is defined by the regulating portion 740.

Although the specific explanation about the present invention is made above referring to the embodiments, the present invention is not limited thereto and is susceptible to various modifications and alternative forms.

Although the lock portion 450, 450E, 720F is the lower surface of the protrusion 440, 440E, 718F, the present invention is not limited thereto. The lock portion 450, 450E, 720F may be a recess, or may be a hole which pierces the lock spring portion 430, 430E, 717.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector in an up-down direction, the mating connector comprising a mating terminal and a locked portion, wherein:

the connector comprises a terminal, a holding member, a first member and a second member;

the holding member holds the terminal, the first member and the second member;

the holding member has at least a first side wall and a second side wall;

the first side wall intersects with a first horizontal direction perpendicular to the up-down direction;

the second side wall intersects with a second horizontal direction perpendicular to both the up-down direction and the first horizontal direction;

the terminal is connected with the mating terminal when the connector is mated with the mating connector;

the first member has a first attached portion, a lock spring portion, a lock portion and a regulated portion;

the first attached portion is attached to the first side wall;

the lock spring portion extends in the first horizontal direction and downward in the up-down direction from the first attached portion;

when the connector and the mating connector are in a mated state where the connector and the mating connector are mated with each other, the lock portion locks the mated state together with the locked portion;

each of the lock portion and the regulated portion is supported by the lock spring portion;

the first member is configured so that, when the mating connector is forced to be unmated from the connector under the mated state, the lock spring portion is resiliently deformed so that each of the lock portion and the regulated portion is moved in a combined direction of upward in the up-down direction and the first horizontal direction;

the second member has a second attached portion and a deformation-preventing portion;

the second attached portion is attached to the second side wall;

the deformation-preventing portion extends downward in the up-down direction from the second attached portion;

the deformation-preventing portion is provided with a regulating portion; and a range of the movement of the regulated portion is defined by the regulating portion.

2. The connector as recited in claim 1, wherein:

the lock spring portion extends inward in the first horizontal direction and downward in the up-down direction from the first attached portion; and the first member is configured so that, when the mating connector is forced to be unmated from the connector under the mated state, the lock spring portion is resiliently deformed so that each of the lock portion and the regulated portion is moved in a combined direction of upward in the up-down direction and inward in the first horizontal direction.

3. The connector as recited in claim 1, wherein the first member and the second member are integrally formed with each other.

4. The connector as recited in claim 1, wherein the second member also functions as the terminal.

5. The connector as recited in claim 1, wherein:

the regulated portion is positioned below the regulating portion in the up-down direction; and an upper limit of the range of the movement of the regulated portion is defined by the regulating portion.

6. The connector as recited in claim 5, wherein:

the holding member is provided with an accommodating portion which accommodates the regulated portion; and the accommodating portion is positioned below the regulating portion in the up-down direction.

7. The connector as recited in claim 1, wherein:

the regulated portion faces the regulating portion in the first horizontal direction; and the range of the movement of the regulated portion in the first horizontal direction is defined by the regulating portion.

8. The connector as recited in claim 7, wherein:

the holding member is provided with an accommodating portion which accommodates the regulated portion; and the accommodating portion neighbors to the regulating portion in the first horizontal direction.

9. A connector assembly comprising the connector as recited in claim 1 and the mating connector.

* * * * *